US011362442B2

(12) United States Patent
McGough et al.

(10) Patent No.: US 11,362,442 B2
(45) Date of Patent: Jun. 14, 2022

(54) DUAL ANTENNA SUPPORT AND ISOLATION ENHANCER

(71) Applicant: PC-TEL, Inc., Bloomingdale, IL (US)

(72) Inventors: Erin McGough, Cuyahoga Falls, OH (US); Scott Lindner, Hudson, OH (US); Thomas Lutman, Berlin Center, OH (US)

(73) Assignee: PCTEL, INC., Bloomingdale, IL (US)

( * ) Notice: Subject to any disclaimer, the term of this patent is extended or adjusted under 35 U.S.C. 154(b) by 175 days.

(21) Appl. No.: 16/999,462

(22) Filed: Aug. 21, 2020

(65) Prior Publication Data

US 2020/0381845 A1 Dec. 3, 2020

Related U.S. Application Data

(62) Division of application No. 16/017,002, filed on Jun. 25, 2018, now Pat. No. 10,862,223.

(51) Int. Cl.
*H01Q 21/26* (2006.01)
*H01P 5/08* (2006.01)
(Continued)

(52) U.S. Cl.
CPC ..... *H01Q 21/26* (2013.01); *H01P 5/085* (2013.01); *H01Q 1/1242* (2013.01); *H01Q 9/0464* (2013.01)

(58) Field of Classification Search
CPC . H01Q 21/26; H01Q 1/12; H01Q 9/04; H01P 5/08
See application file for complete search history.

(56) References Cited

U.S. PATENT DOCUMENTS 5,264,862 A 11/1993 Kumpfbeck
7,916,089 B2 3/2011 Schlub et al.
(Continued)

FOREIGN PATENT DOCUMENTS

CN 104103900 A 10/2014
CN 104300209 A 1/2015

OTHER PUBLICATIONS

Hui Li et al., Compact Planar MIMO Antenna System of Four Elements with Similar Radiation Characteristics and Isolation Structure, IEEE Antennas and Wireless Propagation Letters, vol. 8, 2009, pp. 1107-1110.

(Continued)

*Primary Examiner* — Andrea Lindgren Baltzell
(74) *Attorney, Agent, or Firm* — Husch Blackwell LLP

(57) ABSTRACT

Embodiments disclosed herein include an antenna assembly that includes a dual antenna support and isolation enhancer coupled to a first antenna element for isolating the first antenna element relative to a collocated, vertically-polarized antenna element. The dual antenna support and isolation enhancer can include tabs to support the first antenna element and shield a coaxial cable feeding the first antenna element, a base electrically connected to a shield of the coaxial cable for shorting to ground induced current on the shield of the coaxial cable, and, in some embodiments, at least one of a plurality of loading pins that can form a short-circuited LC resonator that can effectively open-circuit a gap of a coplanar strip transmission line that routes to a feed connection point of the first antenna element when vertically-polarized radiation is incident on the antenna assembly.

10 Claims, 20 Drawing Sheets

(51) Int. Cl.
*H01Q 1/12* (2006.01)
*H01Q 9/04* (2006.01)

(56) References Cited

U.S. PATENT DOCUMENTS

| | | | | |
|---|---|---|---|---|
| 2013/0050031 | A1 | 2/2013 | Zhu et al. | |
| 2013/0222186 | A1 | 8/2013 | Leung et al. | |
| 2014/0242903 | A1* | 8/2014 | DeLuis | H01Q 1/521 343/893 |
| 2017/0118655 | A1* | 4/2017 | Blosco | H04W 16/28 |
| 2019/0103675 | A1* | 4/2019 | McGough | H01Q 9/04 |

OTHER PUBLICATIONS

Youngki Lee et al., Design of a MIMO Antenna with Improved Isolation Using Meta-material, Department of Electronics and Computer Engineering, Hangang University, Seoul, Korea, © 2011 IEEE, pp. 231-234.

H. S. Lee et al., Isolation Improvement between Loop Antennas with Absorber Cells, Department of Electronic Engineering, Kyonggi University, Suwon, Korea, © 2011 IEEE, pp. 1735-1738.

Manoj K. Meshram et al., A Novel Quad-Band Diversity Antenna for LTE and Wi-Fi Applications with High Isolation, IEEE Transactions on Antennas and Propagation, vol. 60, No. 9, Sep. 2012, pp. 4360-4371.

Yu-Tsung Huang et al., Laptop Antenna R&D Center Antenna Business Unit, Wistron NeWeb Corporation, and Wen-Hsiu Hsu, Department of Computerand Communication, Shu-Te University, High Isolation 2.4/5.275.8 GHz WLAN and 2.5 GHz WiMAX Antennas for Laptop Computer Application, Proceedings of Asia-Pacific Microwave Conference 2014, Copyright 2014 IEICE, pp. 977-979.

Mayank Agarwal et al., Department of Electronics Engineering, Indian Institute of Technology (BHU), Varanasi, Isolation Improvement of 5 GHz WLAN Antenna Array using Metamaterial Absorber, 2016 URSI Asia-Pacific Radio Science Conference, Aug. 21-25, 2016, Seoul, Korea, pp. 1050-1053.

Chung-Yi Hsu et al., Department of Electrical Engineering, National Sun Yat-Sen University, Kaohsiung 804, Taiwan, and Fa-Shian Chang et al., Department of Electronics, Cheng Shiu University, Kaohsiung 804, Taiwan, Investigation of a single-plate π-shaped multiple-input-multiple-output antenna with enhanced port isolation for 5 GHz band applications, IET Journals, The Institute of Engineering and Technology, IET Microw. Antennas Propag., 2016, vol. 10, Iss. 5, pp. 553-560, © The Institution of Engineering and and Technology 2016.

Extended European search report from corresponding EP patent application 19182008.3, dated Nov. 11, 2019.

English language translation of CN patent publication 104103900, dated Oct. 15, 2014.

English language translation of CN patent publication 104300209, dated Jan. 21, 2015.

* cited by examiner

Phi / DEGREE VS. dBi

FREQUENCY = 5.5 GHz
MAIN LOBE MAGNITUDE = -0.0726 dBi
MAIN LOBE DIRECTION = 113.0 DEG.

FREQUENCY = 5.5 GHz
MAIN LOBE MAGNITUDE = 4.13 dBi
MAIN LOBE DIRECTION = 0.0 DEG.
ANGULAR WIDTH (3 dB) = 319.5 DEG.
SIDE LOBE LEVEL = -3.0 dB

FREQUENCY = 5.5 GHz
MAIN LOBE MAGNITUDE = 3.97 dBi
MAIN LOBE DIRECTION = 57.0 DEG.
ANGULAR WIDTH (3 dB) = 34.3 DEG.
SIDE LOBE LEVEL = -0.6 dB

FREQUENCY = 5.5 GHz
MAIN LOBE MAGNITUDE = 5.92 dBi
MAIN LOBE DIRECTION = 48.0 DEG.
ANGULAR WIDTH (3 dB) = 35.9 DEG.
SIDE LOBE LEVEL = -0.5 dB

FREQUENCY = 5.5 GHz
MAIN LOBE MAGNITUDE = 4.56 dBi
MAIN LOBE DIRECTION = 56.0 DEG.
ANGULAR WIDTH (3 dB) = 40.9 DEG.
SIDE LOBE LEVEL = -11.1 dB

Phi / DEGREE VS. dBi

FREQUENCY = 5.5 GHz
MAIN LOBE MAGNITUDE = 1.6 dBi
MAIN LOBE DIRECTION = 75.0 DEG.
ANGULAR WIDTH (3 dB) = 47.0 DEG.
SIDE LOBE LEVEL = -1.9 dB

Phi / DEGREE VS. dBi

FREQUENCY = 5.5 GHz
MAIN LOBE MAGNITUDE = -4.31 dBi
MAIN LOBE DIRECTION = 1.0 DEG.
ANGULAR WIDTH (3 dB) = 297.4 DEG.
SIDE LOBE LEVEL = -2.9 dB

FREQUENCY = 5.5 GHz
MAIN LOBE MAGNITUDE = 5.18 dBi
MAIN LOBE DIRECTION = 55.0 DEG.
ANGULAR WIDTH (3 dB) = 38.8 DEG.
SIDE LOBE LEVEL = -2.5 dB

THETA / DEGREE VS. dBi

FREQUENCY = 5.5 GHz
MAIN LOBE MAGNITUDE = 5.99 dBi
MAIN LOBE DIRECTION = 48.0 DEG.
ANGULAR WIDTH (3 dB) = 35.9 DEG.
SIDE LOBE LEVEL = -0.5 dB

FREQUENCY = 5.5 GHz
MAIN LOBE MAGNITUDE = 5.54 dBi
MAIN LOBE DIRECTION = 55.0 DEG.
ANGULAR WIDTH (3 dB) = 41.9 DEG.
SIDE LOBE LEVEL = -10.0 dB

FREQUENCY = 5.5 GHz
MAIN LOBE MAGNITUDE = 5.82 dBi
MAIN LOBE DIRECTION = 46.0 DEG.
ANGULAR WIDTH (3 dB) = 37.9 DEG.
SIDE LOBE LEVEL = -26.3 dB

DUAL ANTENNA SUPPORT AND ISOLATION ENHANCER

CROSS-REFERENCE TO RELATED APPLICATIONS

This application is a divisional of and claims the benefit of the filing date of U.S. application Ser. No. 16/017,002 filed Jun. 25, 2018.

FIELD

The present invention relates generally to radio frequency (RF) communications hardware. More particularly, the present invention relates to a dual antenna support and isolation enhancer.

BACKGROUND

Collocated antennas connected to separate radios allow a RF physical layer to achieve a total throughput near a sum of a throughput of each of the separate radios when the separate radios operate concurrently only if isolation of the collocated antennas mapped to the separate radios exceeds some threshold value. Such required isolation may depend on many factors, including a desired mesh cell size and data rate.

Unfortunately, known isolation techniques suffer from several problems. First, known solutions may have a reduced coverage area due to a compromise of far-field patterns and/or a reduction in antenna efficiency. Second, known solutions can require a large physical separation between antenna elements that may not be feasible for collocated, integrated antennas. Third, any presence of scatterers and/or material discontinuities (e.g. defected ground structure (DGS), frequency selective surface (FSS), RF absorber, etc.) can result in severe degradation of free-space radiation patterns. Finally, a typical isolation resulting from known systems and methods of well-isolated, closely-spaced, cross-polarized, omnidirectional antennas is around 35 dB, which is much lower than a preferred 60 dB of isolation for closely-spaced, cross-polarized, omnidirectional antennas.

FIG. 1 is a perspective view of a multiple antenna system 20A employing no isolation techniques. As seen in FIG. 1, the multiple antenna system 20A includes a single-band antenna 22 and a dual-band antenna 24 coupled to a single continuous ground plane 26. For example, the single-band antenna 22 can include the antenna disclosed in U.S. patent application Ser. No. 15/944,950, and the dual-band antenna 24 can include the antenna disclosed in U.S. patent application Ser. No. 15/962,064. In practice, the ground plane 26 can include a 100 mm radius, the single-band antenna 22 and the dual-band antenna 24 can be spaced 60 mm (equivalent to 1λ at 5 GHz) from center to center on the x-axis, and the center of each of the antennas 22, 24 can be displaced from a center of the ground plane 26 by 30 mm, including an air gap between the antennas 22, 24 of approximately 29 mm. Such positioning is a good approximation of each of the antennas 22, 24 residing in the other's far-field so that their electric fields are linearly polarized and align with one of the global coordinate axes shown at the bottom right of FIG. 1. In particular, the dual-band antenna 24 can be linearly polarized in the z-direction (vertically-polarized) in a plane of the single-band antenna 22, and the single-band element 22 can be linearly polarized in the y-direction (horizontally-polarized) in the x-z plane at a location of the dual-band antenna 24.

In general, at 5.5 GHz, two 0 dBi co-polarized antennas are approximately 23 dB coupled at a 60 mm spacing. However, FIG. 2 is a graph of the isolation of the single-band antenna 22 and the dual-band antenna 24 in the multiple antenna system 20A of FIG. 1, where Port 1 and Port 2 are the dual-band antenna 24 and the single-band antenna 22, respectively. As seen in FIG. 2, the isolation ($S_{21}$) is approximately 38 dB at 5.5 GHz. There are two mechanisms that limit the isolation in FIG. 1. First, induced current on a shield of a coaxial cable feeding the single-band antenna 22 flows into its port at an end of its coaxial cable. In this regard, the induced current on the shield of the coaxial cable is shown at a single instant of time in FIG. 3. Second, a radiated electric field of the dual-band antenna 24 is not purely vertically-polarized, thereby inducing a slight potential across a gap 28 of a coplanar strip transmission line of the single-band antenna 22. In this regard, the electric field in the plane of the single-band antenna 22 is shown in FIG. 4. As seen in FIG. 4, a direction of the electric field resides in the plane of the single-band antenna 22 and is perpendicular to the coplanar strip transmission line, thereby demonstrating coupling to the single-band antenna 22. A voltage standing wave ratio (VSWR) and efficiency (dB) of the single-band antenna 22 and the dual-band antenna 24 in the multiple antenna system 20A of FIG. 1 are shown in FIG. 5 and FIG. 6 respectively, and radiation patterns for the single-band antenna 22 and the dual-band antenna 24 in the multiple antenna system 20A of FIG. 1 are shown in FIG. 7-FIG. 12. As seen in FIG. 5-FIG. 12, the single-band antenna 22 and the dual-band antenna 24 in the multiple antenna system 20A of FIG. 1 are efficient and have radiation patterns that are suitable for deployment in a ceiling-mounted access point. However, it is desirable to further isolate the antennas 22, 24.

In view of the above, there is a continuing, ongoing need for improved antenna systems.

DETAILED DESCRIPTION

Figure 1:
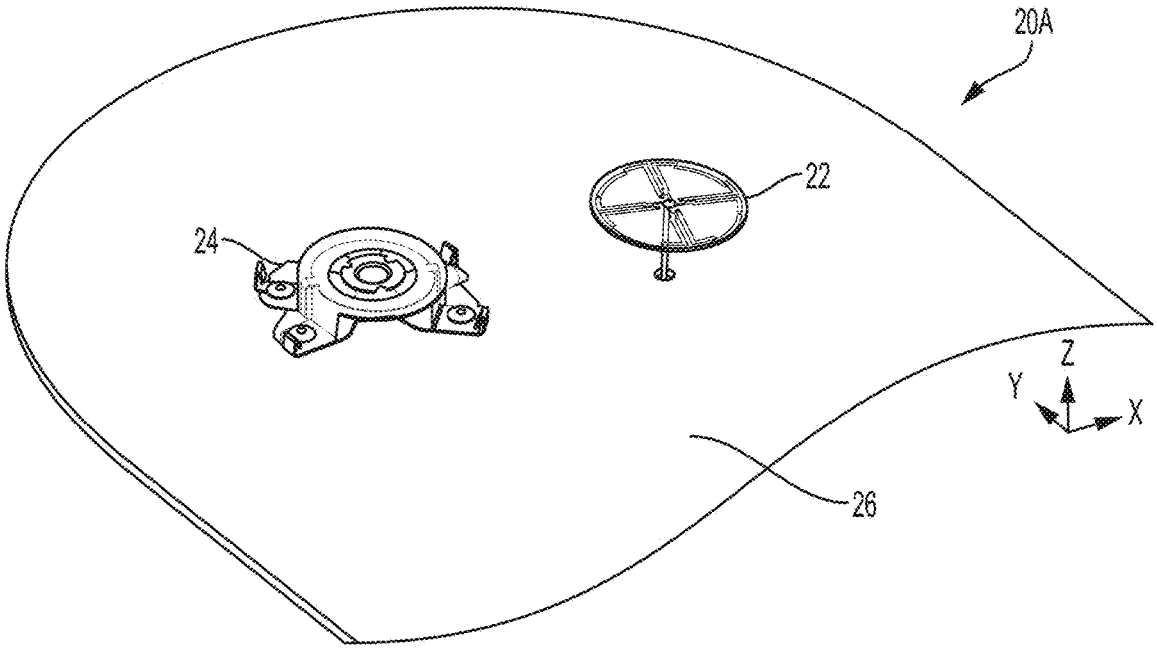
FIG. 1 is a perspective view of a multiple antenna system known in the art.

While this invention is susceptible of an embodiment in many different forms, there are shown in the drawings and will be described herein in detail specific embodiments thereof with the understanding that the present disclosure is to be considered as an exemplification of the principles of the invention. It is not intended to limit the invention to the specific illustrated embodiments.

Embodiments disclosed herein can include an antenna assembly that includes a dual antenna support and isolation enhancer coupled to an antenna element. As used herein, it is to be understood that the term "dual" refers to the device disclosed herein being both an antenna support device and an isolation enhancer device. Accordingly, the dual antenna support and isolation enhancer serves both critical mechanical and electromagnetic purposes.

The dual antenna support and isolation enhancer disclosed herein can offer at least two advantages relative to known mounting and isolations solutions. First, the dual antenna support and isolation enhancer can be cheaper than using nylon hardware (spacers) to mount antenna elements etched on a printed circuit board parallel to a ground plane. Second, the dual antenna support and isolation enhancer can enhance isolation between a single-band antenna, such as the antenna disclosed in U.S. patent application Ser. No. 15/944,950, and any other strongly vertically-polarized antenna element (i.e. greater than 10 dB x-pol ratio with respect to a direction of a center of the h-pol antenna) at proximity (i.e. greater than 2 inches, 50 mm), such as the antenna disclosed in U.S. patent application Ser. No. 15/962,064.

In accordance with disclosed embodiments, the dual antenna support and isolation enhancer can short to ground induced current on a shield of a coaxial cable by electrically connecting the shield with a base of the dual antenna support and isolation enhancer, which can be fastened to the ground plane. Advantageously, such shorting can reduce current flow into a radio area within an access point product, which can reduce energy that couples into an RF connector at a radio or measurement port, thereby improving antenna isolation and receive sensitivity when two or more radios operate concurrently.

Furthermore, in accordance with disclosed embodiments, the dual antenna support and isolation enhancer can include at least one short-circuited LC resonator that can load a gap of a coplanar strip transmission line that routes to a feed connection point of the antenna element supported by the dual antenna support and isolation enhancer. A length of the short-circuited LC resonator and a width of the gap can form an LC circuit and be varied to tune the isolation over frequency. For example, the short-circuited LC resonator may be adjusted to obtain 60 dB of isolation over a 5.15-5.85 GHz frequency range on a large ground plane at a separation of 60 mm between cross-polarized antenna elements.

In some embodiments, the dual antenna support and isolation enhancer can use some combination of properly oriented support tabs and loading pins (1) to shield the shield of the coaxial cable and (2) to open-circuit the coplanar strip transmission line of the antenna element by enforcing a z-directed electric field in the gap of the coplanar strip transmission line. For example, an orientation of the support tabs and/or the loading pins with respect to the vertically-polarized antenna element can change coupling to the exposed, vertically-oriented shield of the coaxial cable feeding the antenna element supported by the dual antenna support and isolation enhancer and can improve the isolation between the cross-polarized antennas. In some embodiments, the support tabs can support the antenna element and be at or near a quarter wavelength of a design frequency of the antenna element. Furthermore, in some embodiments, the loading pins can form short-circuited resonators that can be used to tune the coupling between the cross-polarized antennas. Although embodiments disclosed herein are described in connection with the dual antenna support and isolation enhancer including both the support tabs and the loading pins, it is to be understood that embodiments disclosed herein are not so limited and that the dual antenna support and isolation enhancer can include the support tabs without the loading pins.

Figure 13:
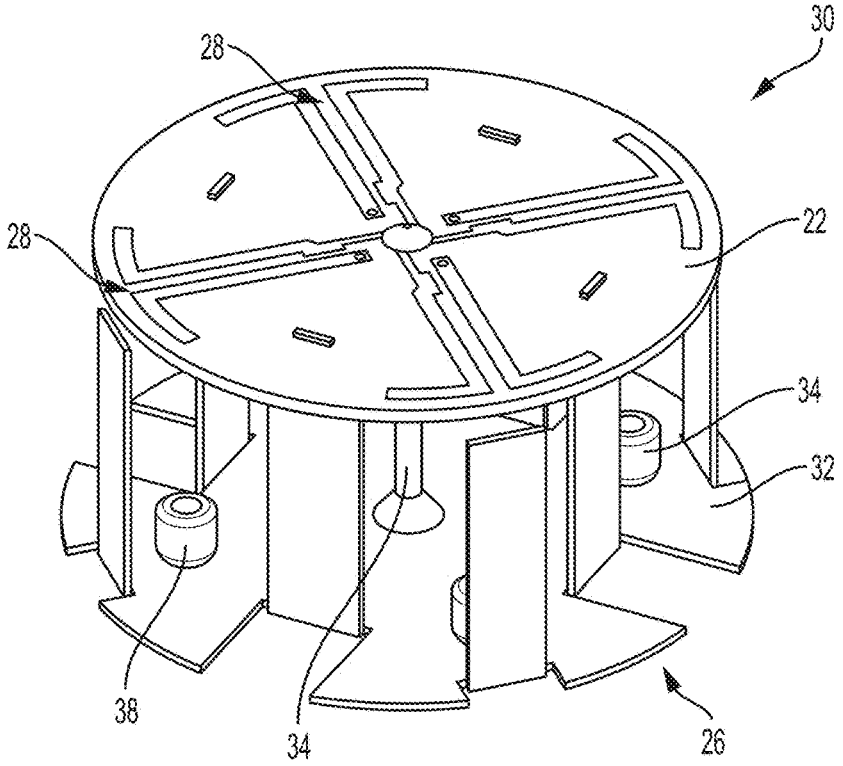
FIG. 13 is a perspective view of an antenna assembly in accordance with disclosed embodiments.

FIG. 13 is perspective view of an antenna assembly 30 in accordance with disclosed embodiments. The antenna assembly 30 can include a first antenna element, such as the single-band antenna 22 shown in FIG. 1, a dual antenna support and isolation enhancer 32, and a coaxial cable 34. As seen in FIG. 13, a shield of the coaxial cable 34 can be soldered to the dual antenna support and isolation enhancer 32, and the dual antenna support and isolation enhancer 32 can be coupled to the ground plane 26 by fasteners 38 and support the single-band antenna 22 in an elevated position relative to the ground plane 26. In some embodiments, the single-band antenna 22 can be oriented parallel to the ground plane 26. Advantageously, the dual antenna support and isolation enhancer 32 can shield the shield of the coaxial cable 34 and open-circuit the gap 28 of the coplanar strip transmission line of the single-band antenna 22 when the single-band antenna 22 is exposed to radiation from a vertically-polarized source.

While embodiments disclosed herein are described in connection with the dual antenna support and isolation enhancer 32 being used in conjunction with the single-band antenna 22, it is to be understood that embodiments disclosed herein are not so limited. Instead, the dual antenna support and isolation enhancer 32 could be used with any other antenna element as would be known and understood by one of ordinary skill in the art.

Figure 14:
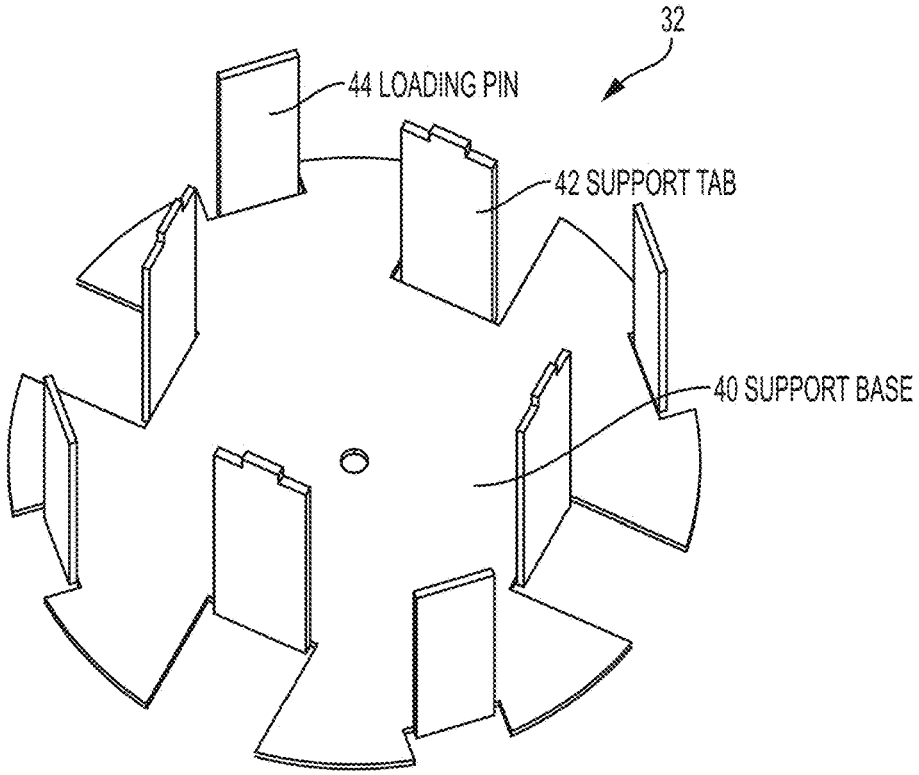
FIG. 14 is a perspective view of a dual antenna support and isolation enhancer in accordance with disclosed embodiments.

FIG. 14 is a perspective view of the dual antenna support and isolation enhancer 32 in accordance with disclosed embodiments. As seen in FIG. 14, the dual antenna support and isolation enhancer 32 can include a support base 40, a plurality of support tabs 42 (for example, at least two), and a plurality of loading pins 44. In some embodiments, a combination of the support base 40, the plurality of support tabs 42, and the plurality of loading pins 44 can form a single monolithic structure.

Figure 15:
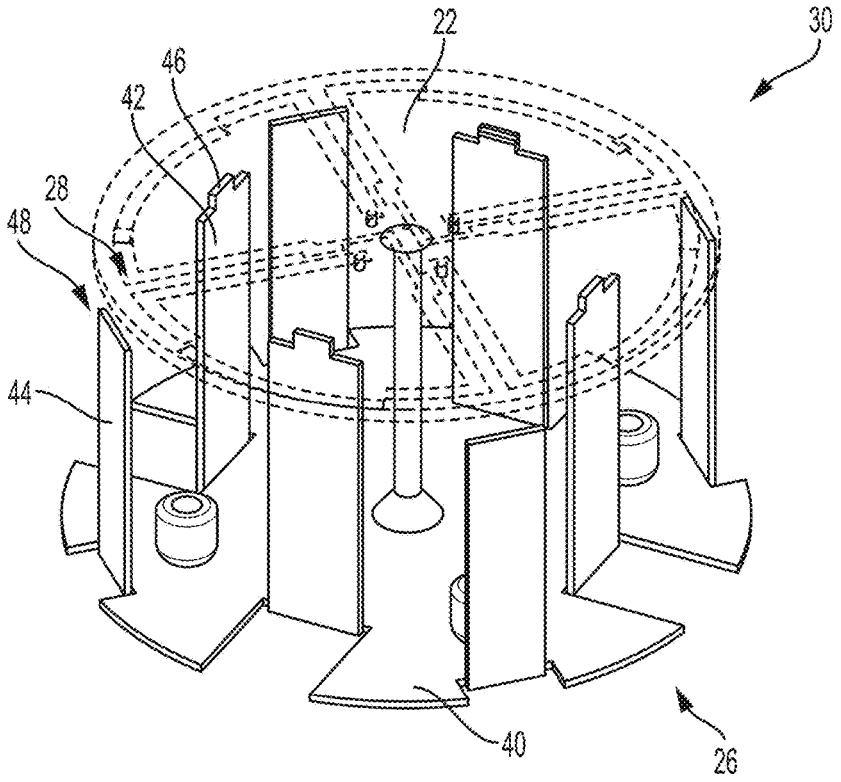
FIG. 15 is a perspective view of a dual antenna support and isolation enhancer with a single-band antenna element shown in phantom in accordance with disclosed embodiments.

FIG. 15 is a perspective view of the antenna assembly 30 with the single-band antenna 22 shown in phantom in accordance with disclosed embodiments. As seen in FIG. 15, the plurality of support tabs 42 can be coupled to the single-band antenna 22 to support the single-band antenna 22 in the elevated position relative to the support base 40 and the ground plane 26. In some embodiments, the plurality of support tabs 42 can have a length that is or near a quarter wavelength of a design frequency of the single-band antenna 22. Additionally or alternatively, in some embodiments, a respective protrusion 46 on each of the plurality of support tabs 42 can traverse a printed circuit board of the single-band antenna 22, thereby adhering the single-band antenna 22 to the dual antenna support and isolation enhancer 32.

As further seen in FIG. 15, the plurality of loading pins 44 can be separated from the single-band antenna 22 by a gap 48. As disclosed herein, a size of the gap 48 and a length of each of the plurality of loading pins 44 can be tuned to isolate the single-band antenna 22 from a vertically-polarized antenna over a wide frequency range, including a 5.15-5.85 GHz frequency range. In some embodiments, the length of each of the plurality of loading pins 44 can be tuned to a quarter wavelength of a design frequency of a second antenna element from which the dual antenna support and isolation enhancer 32 is isolating the single-band antenna 22, such as the dual-band antenna 24 shown in FIG. 1.

Figure 3:
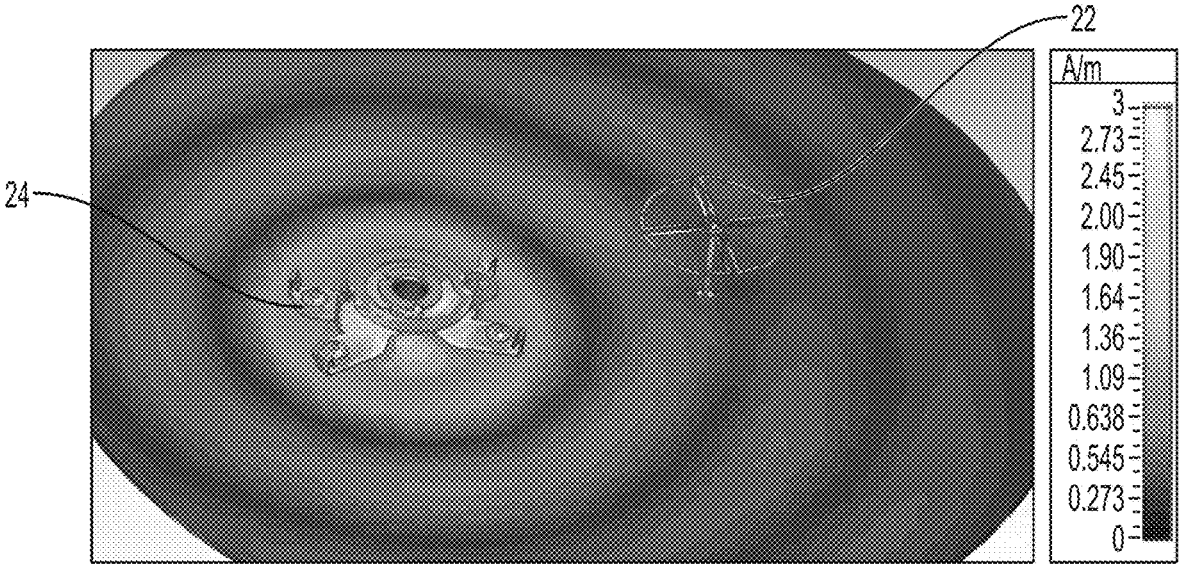
FIG. 3 is a graph illustrating surface current distribution of the multiple antenna system of FIG. 1 at a single instant of time.
Figure 4:
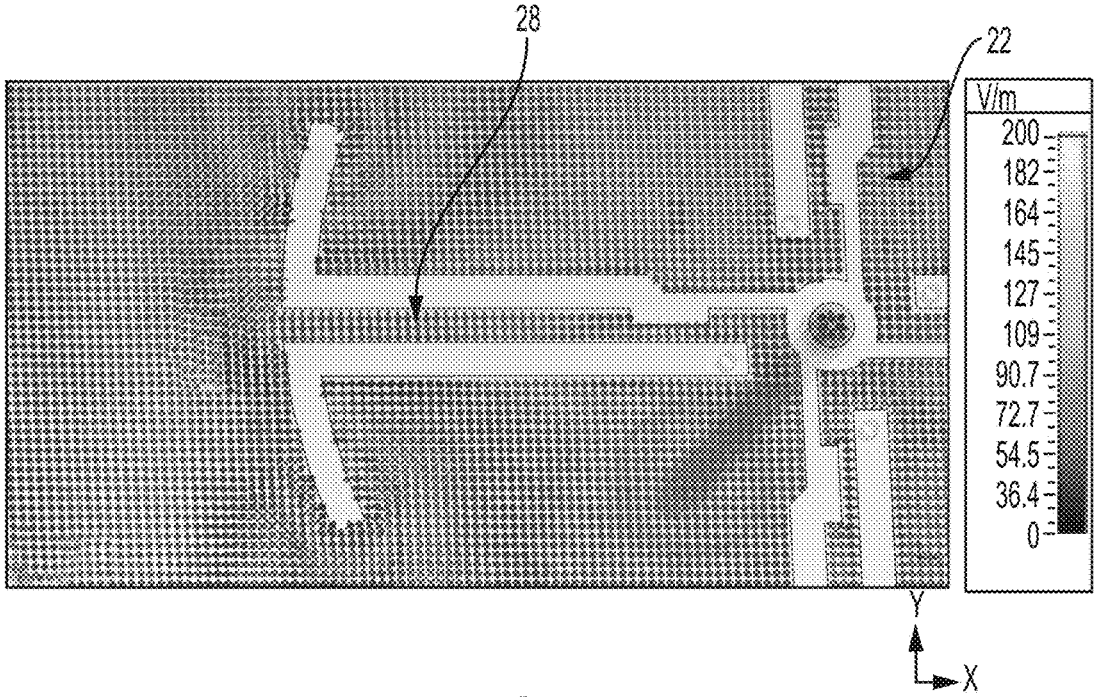
FIG. 4 is a graph illustrating electric field distribution of the multiple antenna system of FIG. 1 at a single instant of time.
Figure 5:
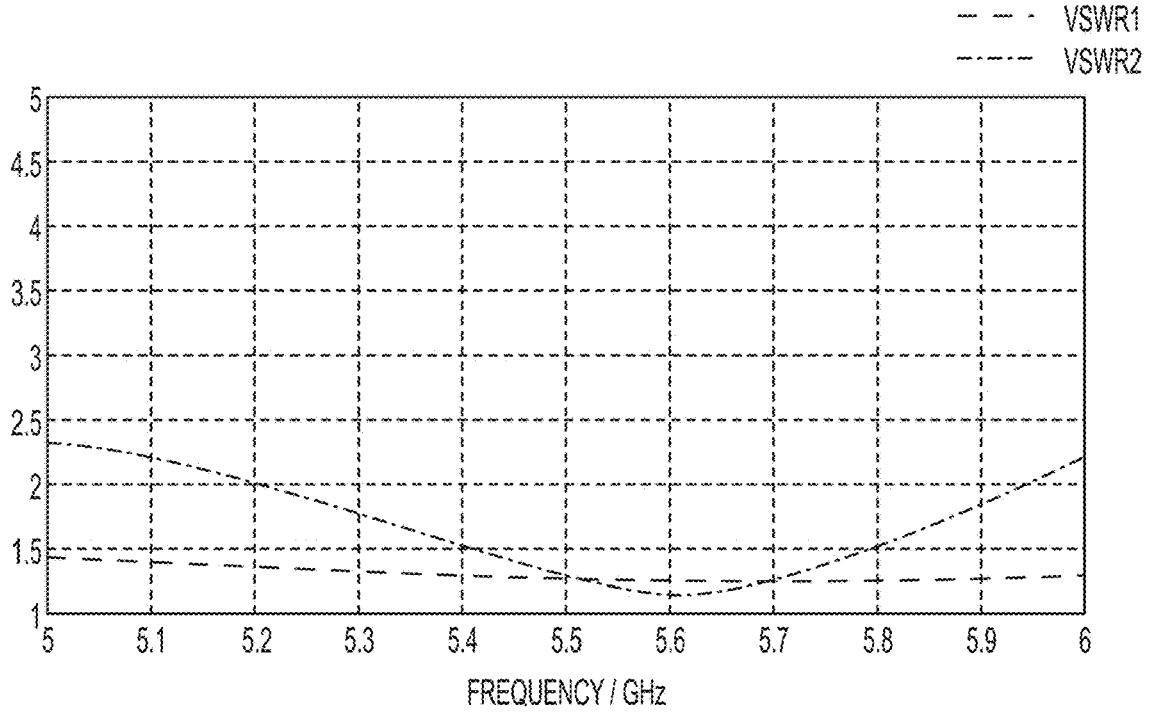
FIG. 5 is a graph of a voltage standing wave ratio of the dual-band antenna and the single-band antenna of the multiple antenna system of FIG. 1.
Figure 6:
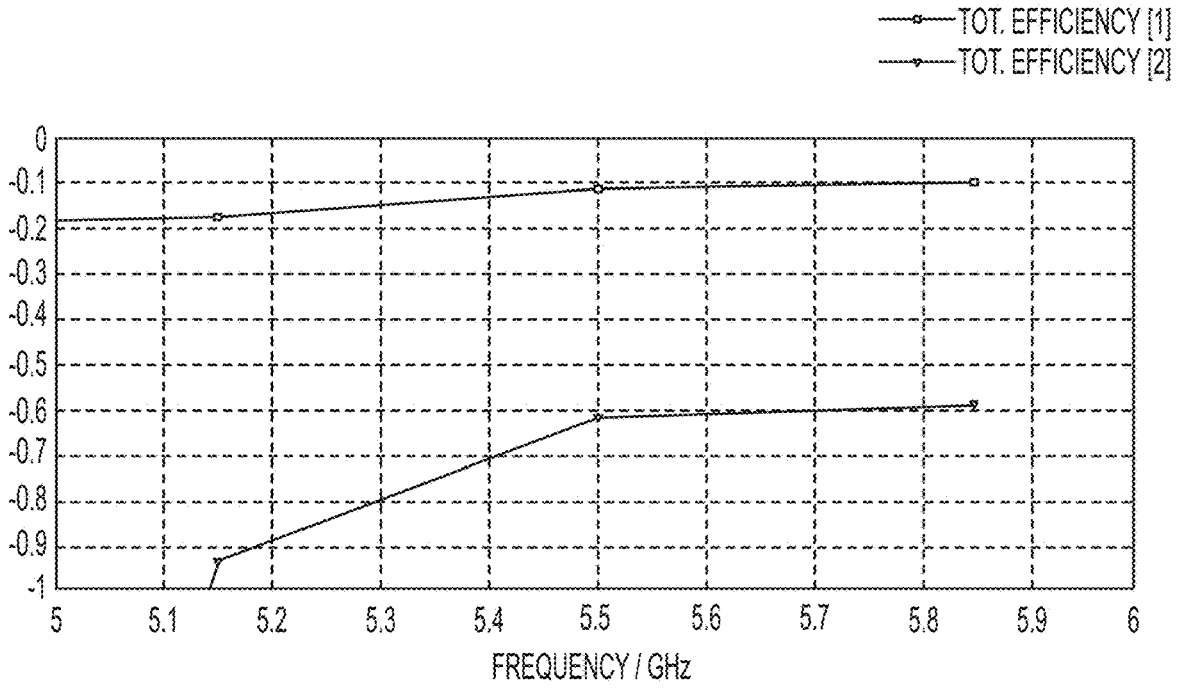
FIG. 6 is a graph of efficiency (dB) of the dual-band antenna and the single-band antenna of the multiple antenna system of FIG. 1.
Figure 7:
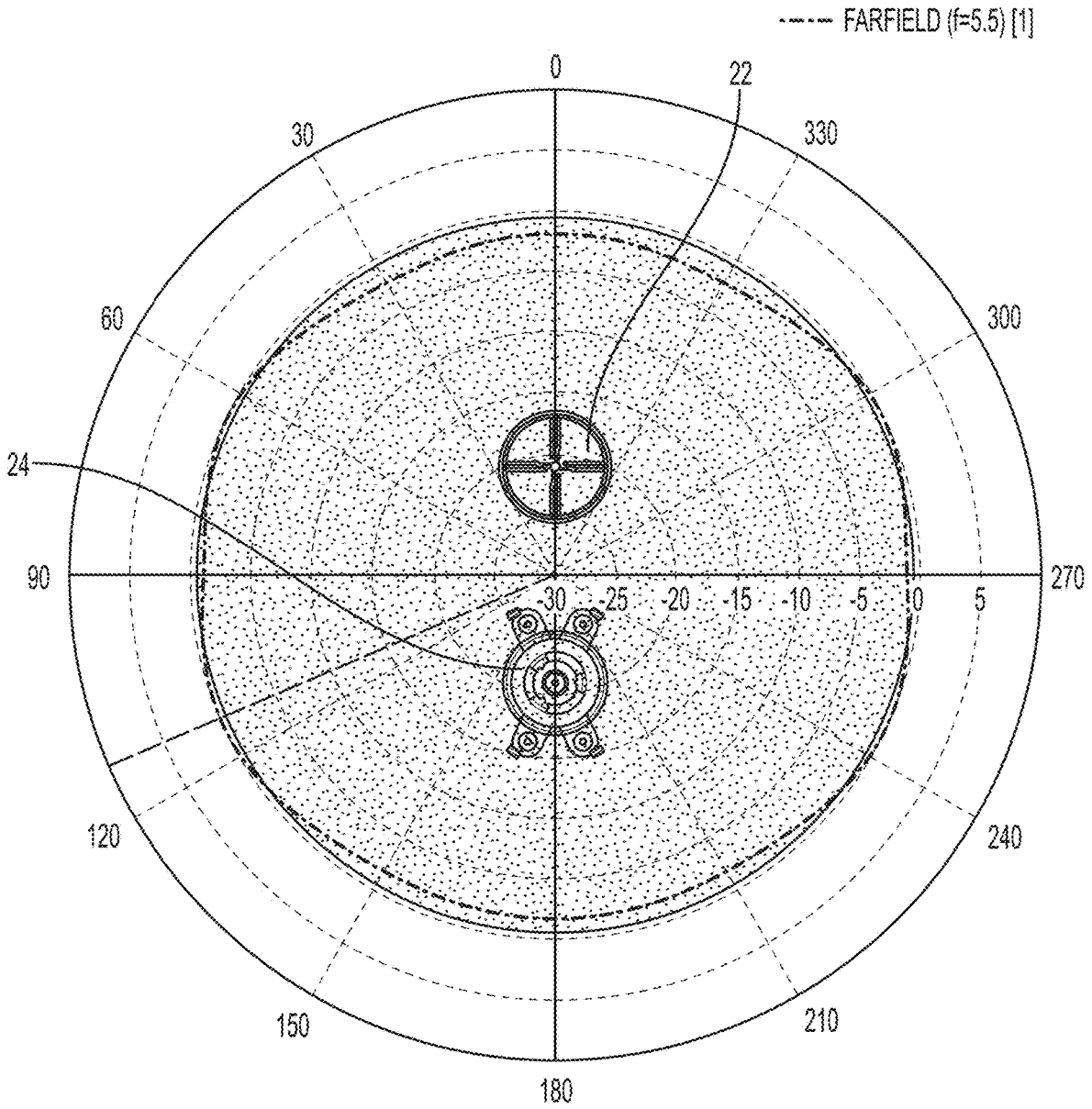
FIG. 7 is a graph of an azimuth plane radiation pattern of the dual-band antenna of the multiple antenna system of FIG. 1.
Figure 8:
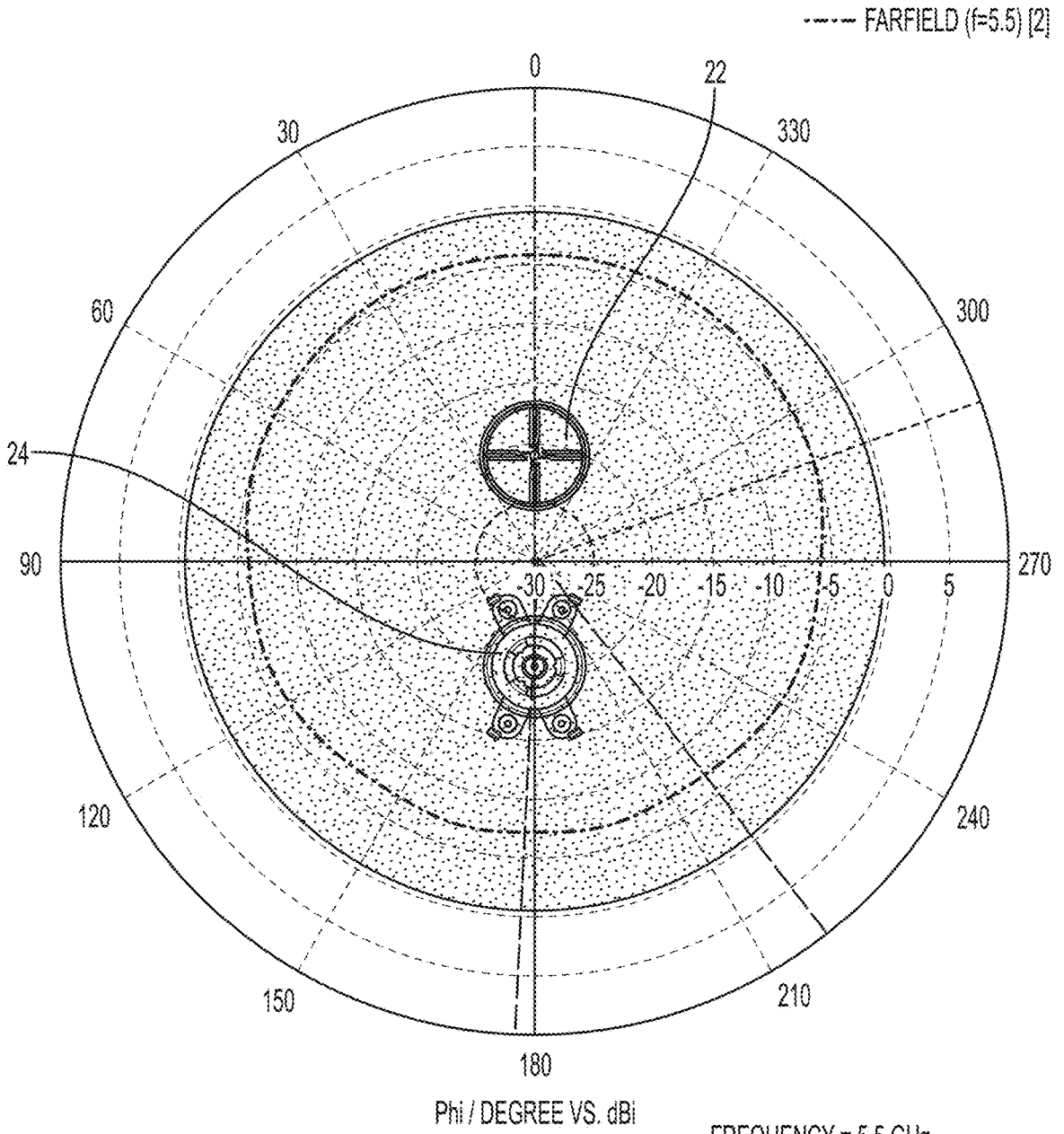
FIG. 8 is a graph of an azimuth plane radiation pattern of the single-band antenna of the multiple antenna system of FIG. 1.
Figure 9:
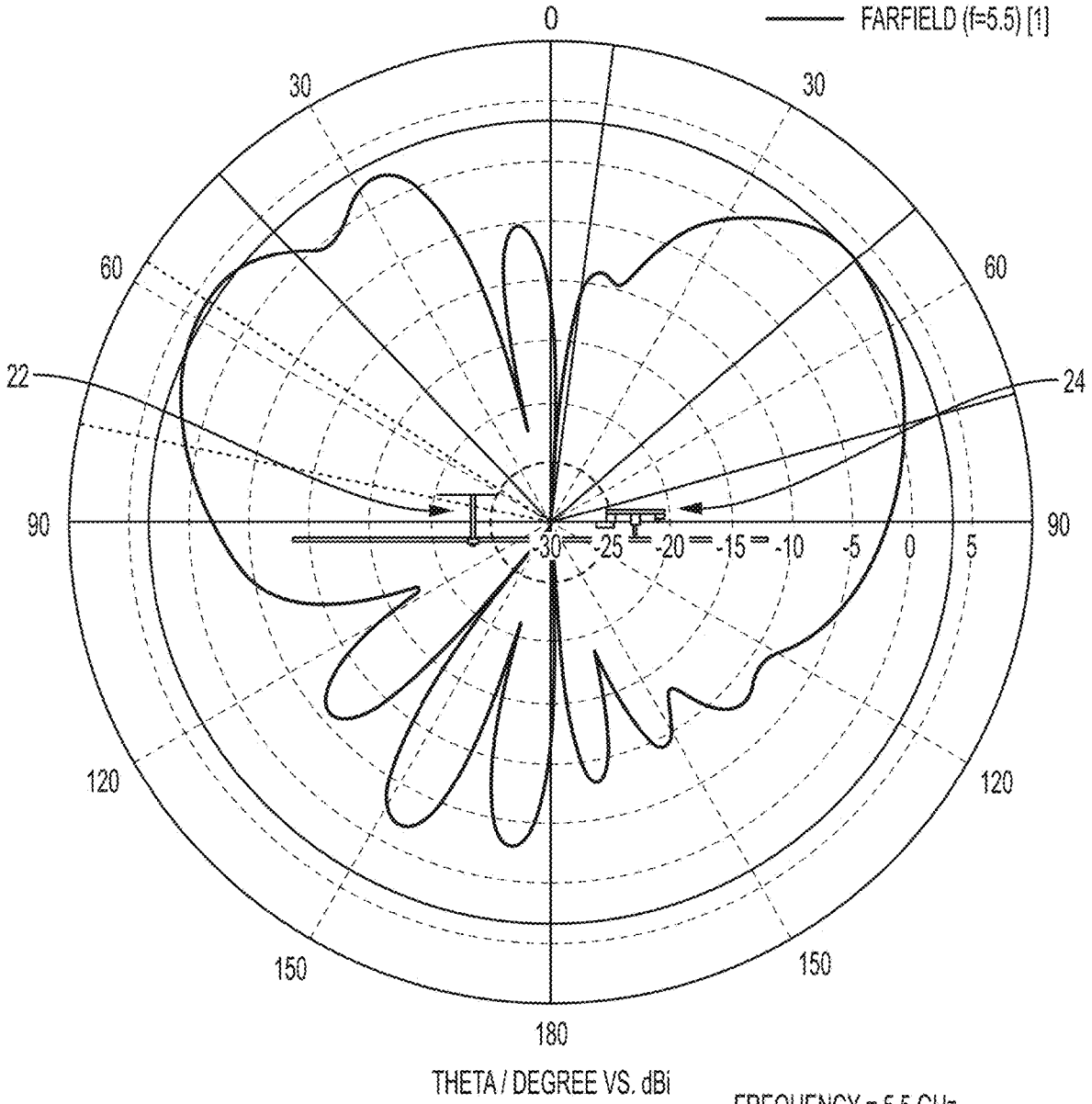
FIG. 9 is a graph of a Φ=0 elevation plane radiation pattern of the dual-band antenna of the multiple antenna system of FIG. 1.
Figure 10:
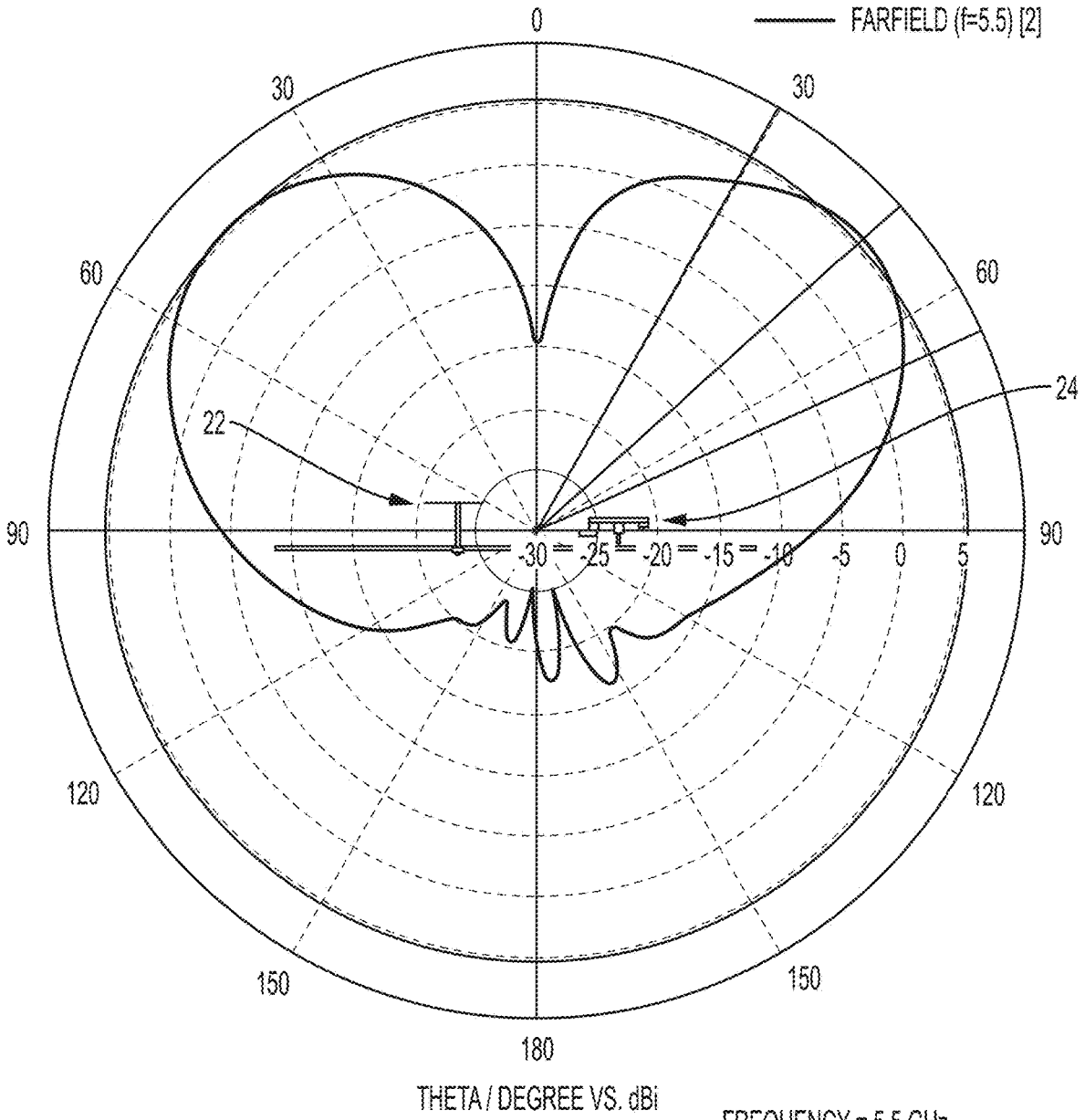
FIG. 10 is a graph of a Φ=0 elevation plane radiation pattern of the single-band antenna of the multiple antenna system of FIG. 1.
Figure 11:
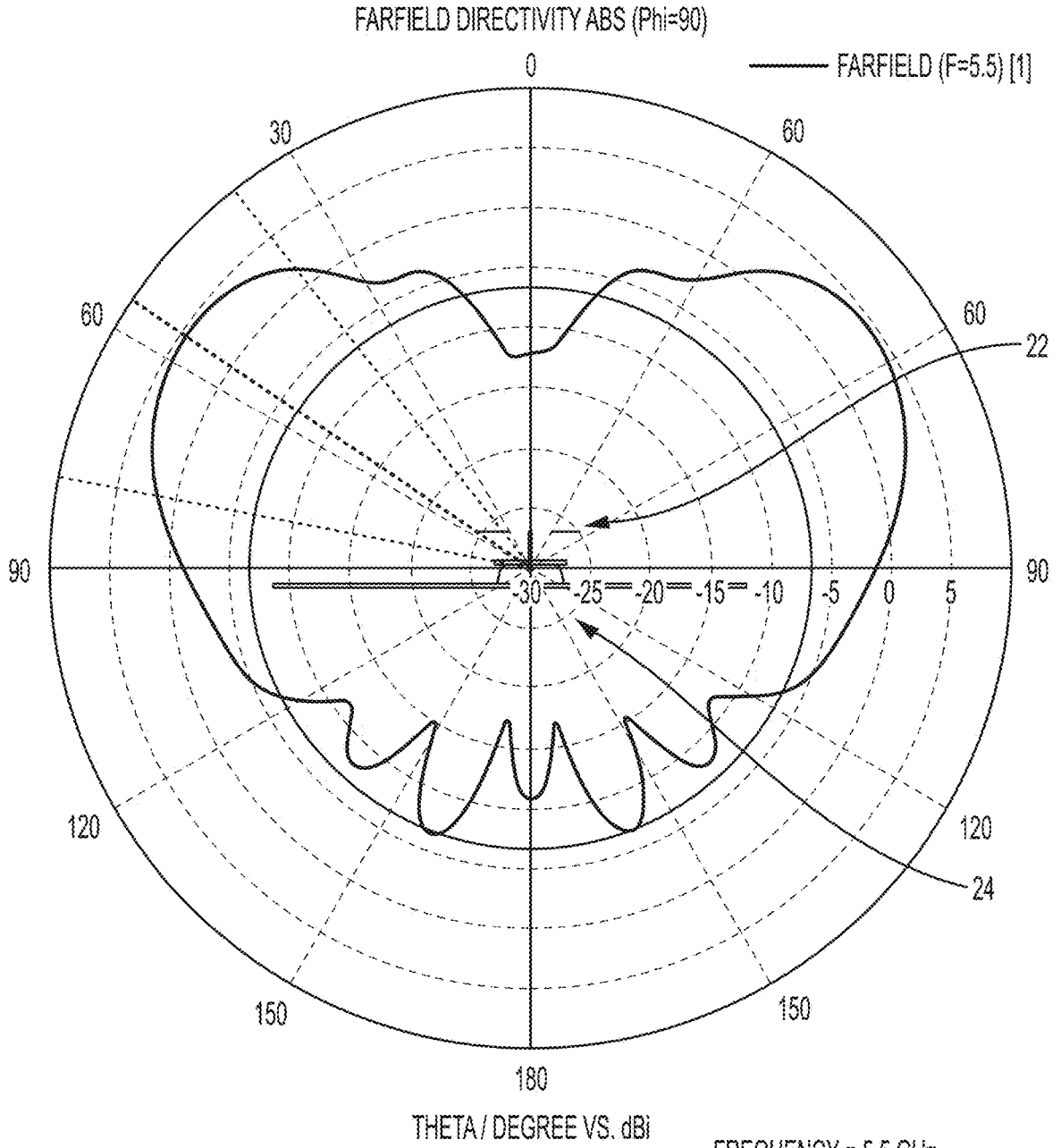
FIG. 11 is a graph of a Φ=90 elevation plane radiation pattern of the dual-band antenna of the multiple antenna system of FIG. 1.
Figure 12:
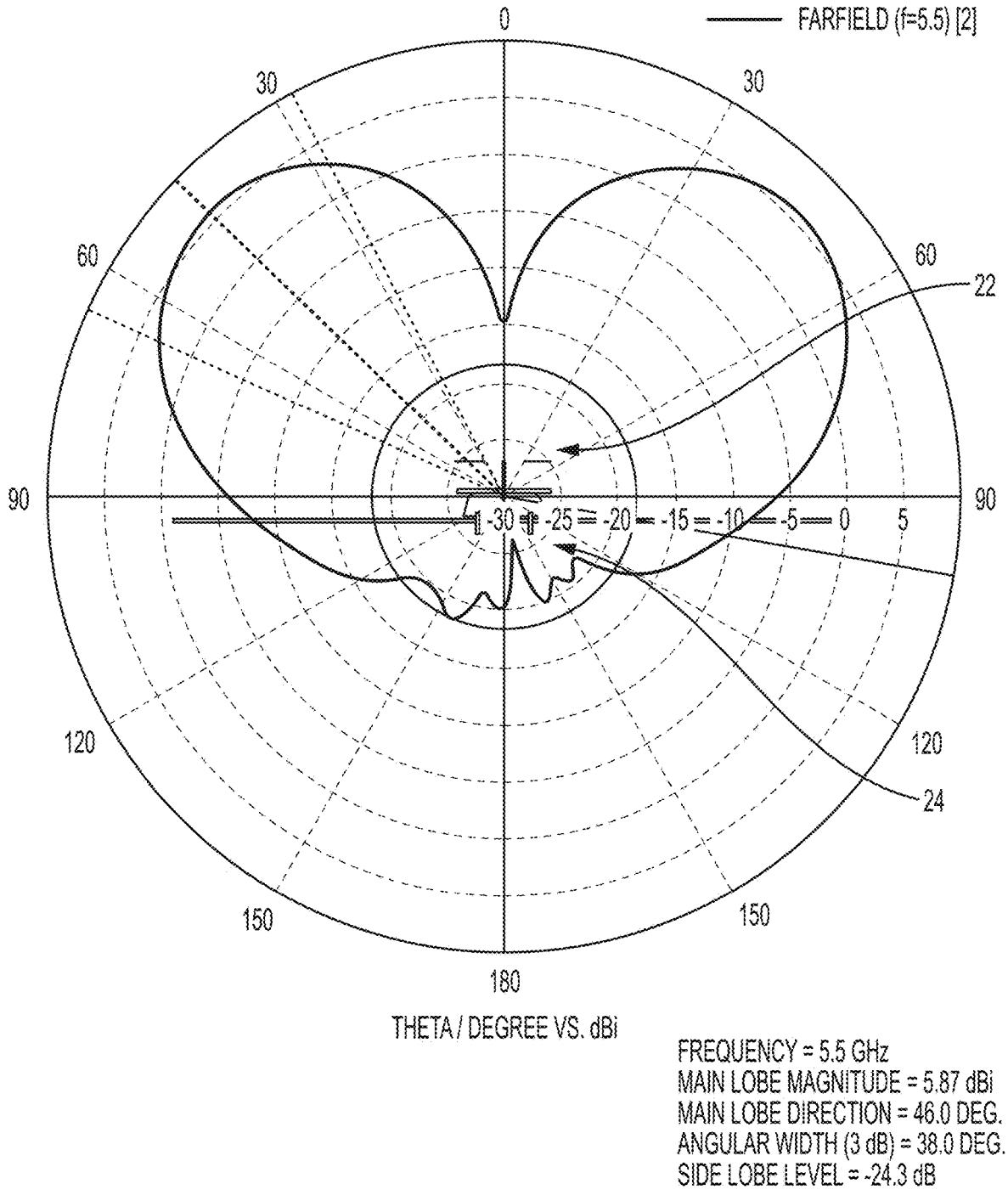
FIG. 12 is a graph of a Φ=90 elevation plane radiation pattern of the single-band antenna of the multiple antenna system of FIG. 1.
Figure 16:
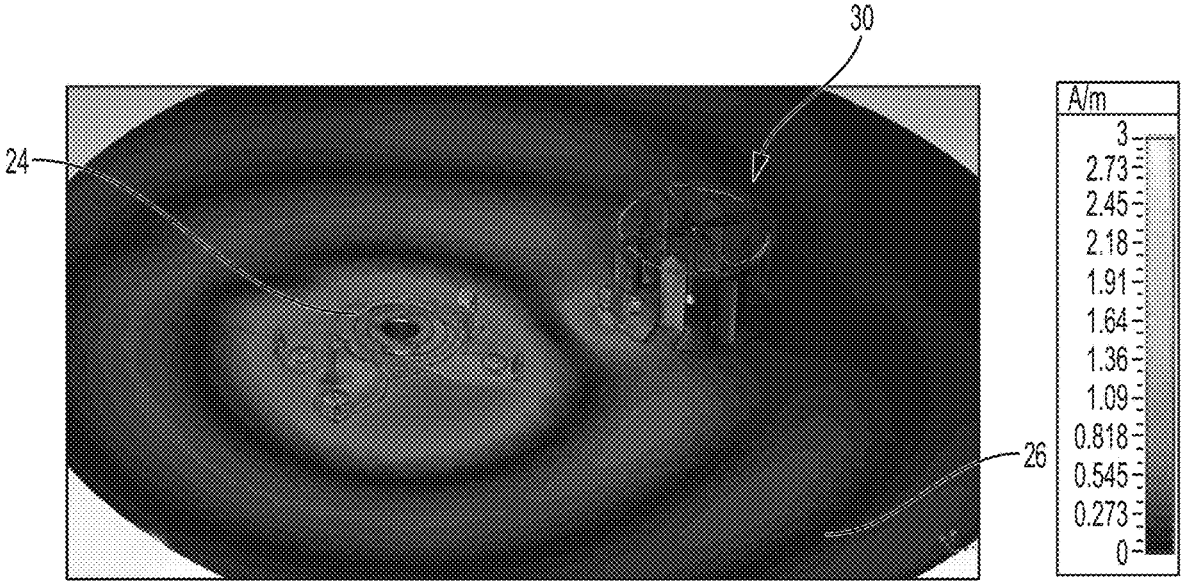
FIG. 16 is a graph illustrating surface current distribution of a multiple antenna system in accordance with disclosed embodiments at a single instant of time.
Figure 17:
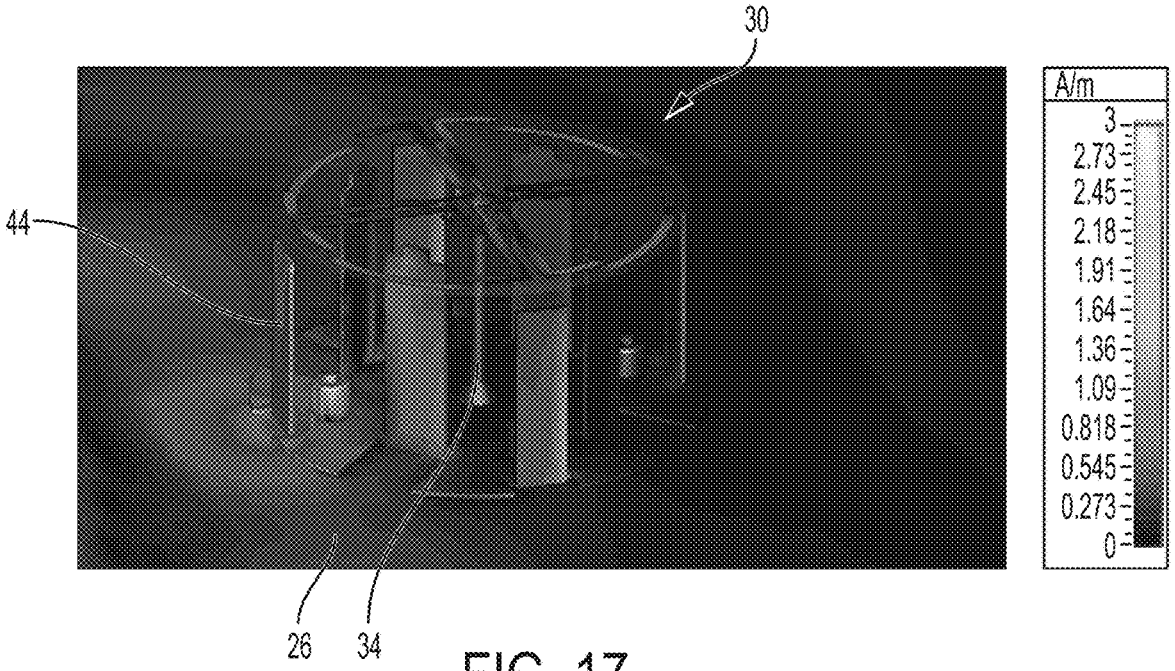
FIG. 17 is a graph illustrating a close up view of the surface current distribution illustrated in FIG. 16.

In some embodiments, both the dual-band antenna 24 and the antenna assembly 30 that includes the single-band antenna 22 can be coupled to the ground plane 26 to form a multiple antenna system. In these embodiments, the dual-band antenna 24 can source external radiation that would otherwise induce high current on the shield of the coaxial cable 34 and couple to the coplanar strip transmission line of the single-band antenna 22 without the dual antenna support and isolation enhancer 32. However, as disclosed herein, the dual antenna support and isolation enhancer 32 can isolate the single-band antenna 22 from the dual-band antenna 24. For example, FIG. 16 and FIG. 17 are graphs illustrating surface current distribution of the multiple antenna system including the dual-band antenna 24 and the antenna assembly 30 that includes the single-band antenna 22. As seen in FIG. 16 and FIG. 17, at least one of the plurality of loading pins 44 can be positioned between the dual-band antenna 24 and the coaxial cable 34 and can be resonant in a plane of the shield of the coaxial cable 34 so as to significantly reduce an amplitude of induced surface current on the shield 34 of the coaxial cable 34 when compared with the induced surface current without the dual antenna support and isolation enhancer 32 illustrated in in FIG. 3. As further seen in FIG. 16 and FIG. 17, soldering the shield of the coaxial cable 34 to a top of the support base 40 can retain the induced surface current to an antenna-side of the ground plane 26, thereby limiting current flow into a radio area within an access point product and/or into an RF connector.

Figure 18:
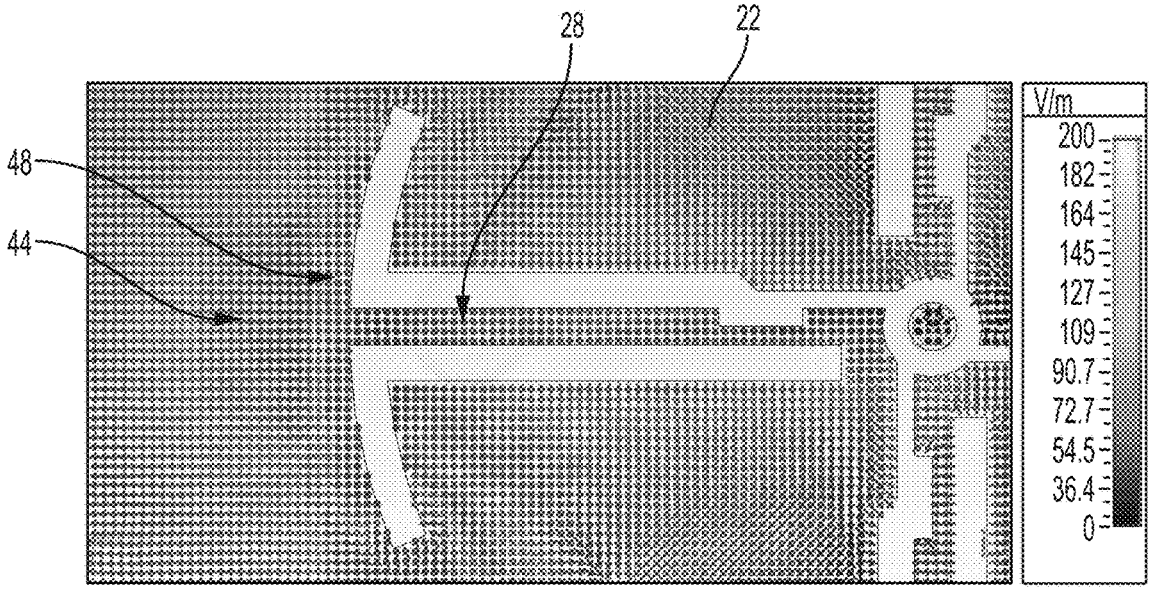
FIG. 18 is a graph illustrating electric field distribution of a multiple antenna system in accordance with disclosed embodiments at a single instant of time.

FIG. 18 is a graph illustrating electric field distribution in the gap 28 of the coplanar strip transmission line of the single-band antenna 22 coupled to the dual antenna support and isolation enhancer 32. As seen in FIG. 18, a direction of the electric field at a tip end of the at least one of the plurality of loading pins 44 can dominate the electric field distribution overall within the gap 28 of the coplanar strip transmission line, thereby open-circuiting the coplanar strip transmission line and further isolating the cross-polarized antennas.

Figure 2:
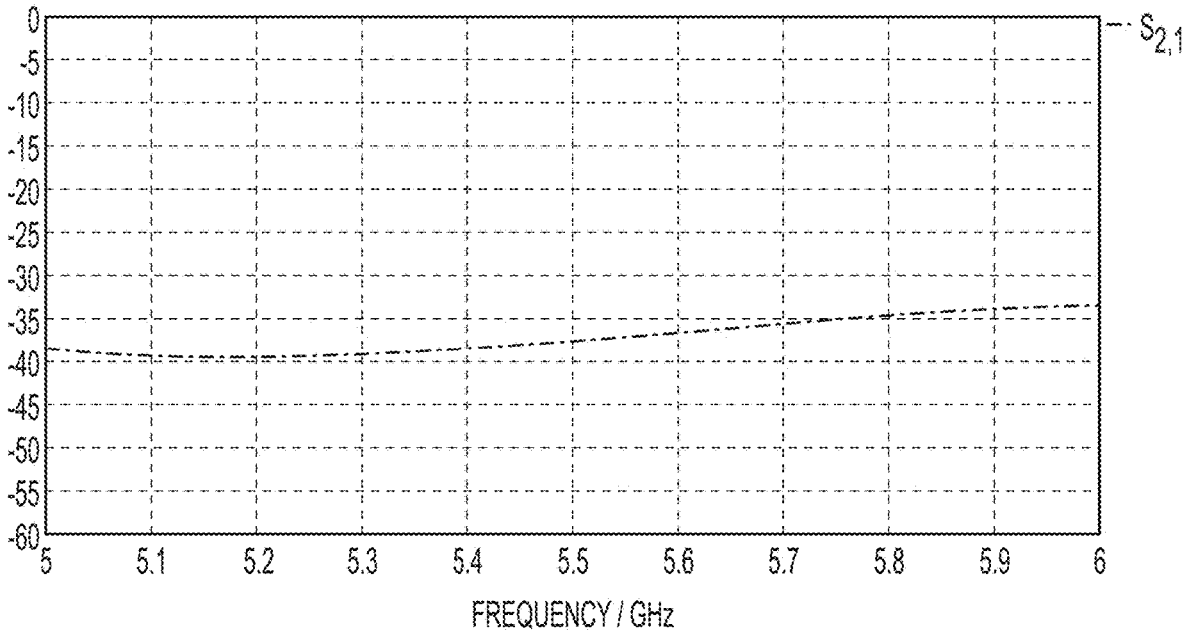
FIG. 2 is a graph of isolation between the dual-band antenna and the single-band antenna of the multiple antenna system of FIG. 1.
Figure 19:
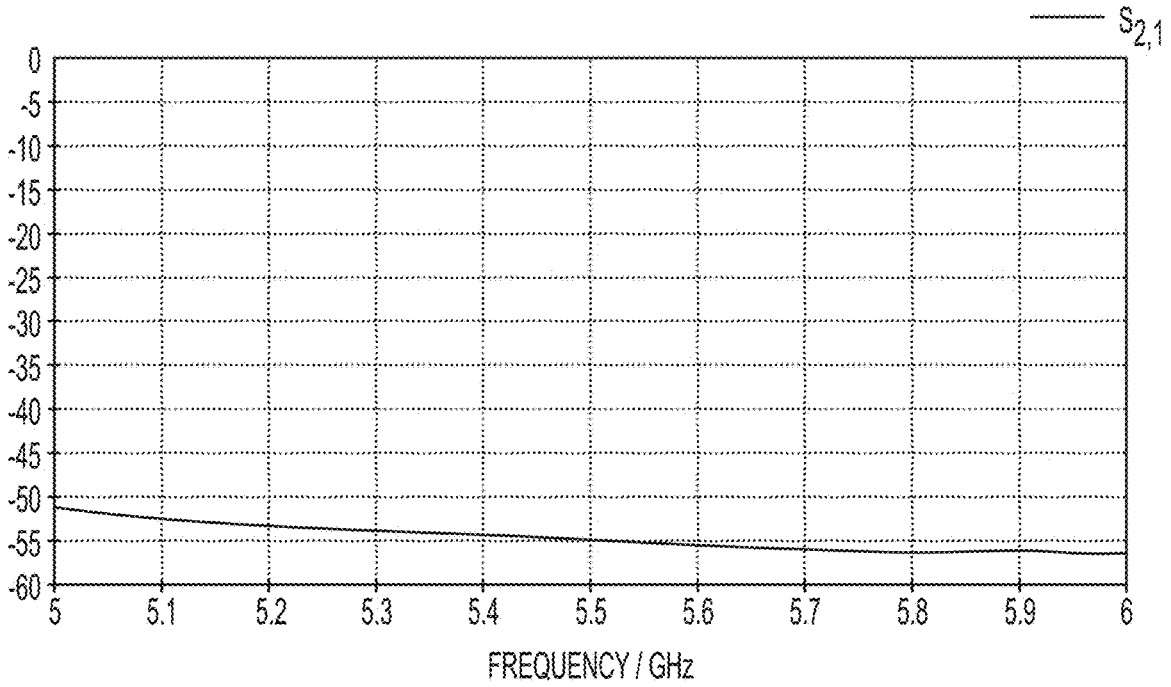
FIG. 19 is a graph of isolation of a dual-band antenna and a single-band antenna of a multiple antenna system in accordance with disclosed embodiments.

FIG. 19 is a graph of isolation between the dual-band antenna 24 and the single-band antenna 22 coupled to the dual antenna support and isolation enhancer 32. As seen in FIG. 19, the isolation at 5.5 GHz is 55 dB, which is a 17 dB improvement in isolation when compared with the isolation without the dual antenna support and isolation enhancer 32 shown in FIG. 2. In some embodiments, the dual antenna support and isolation enhancer 32 can improve the isolation by approximately 10 dB on average over the 5 GHz frequency band.

Figure 20:
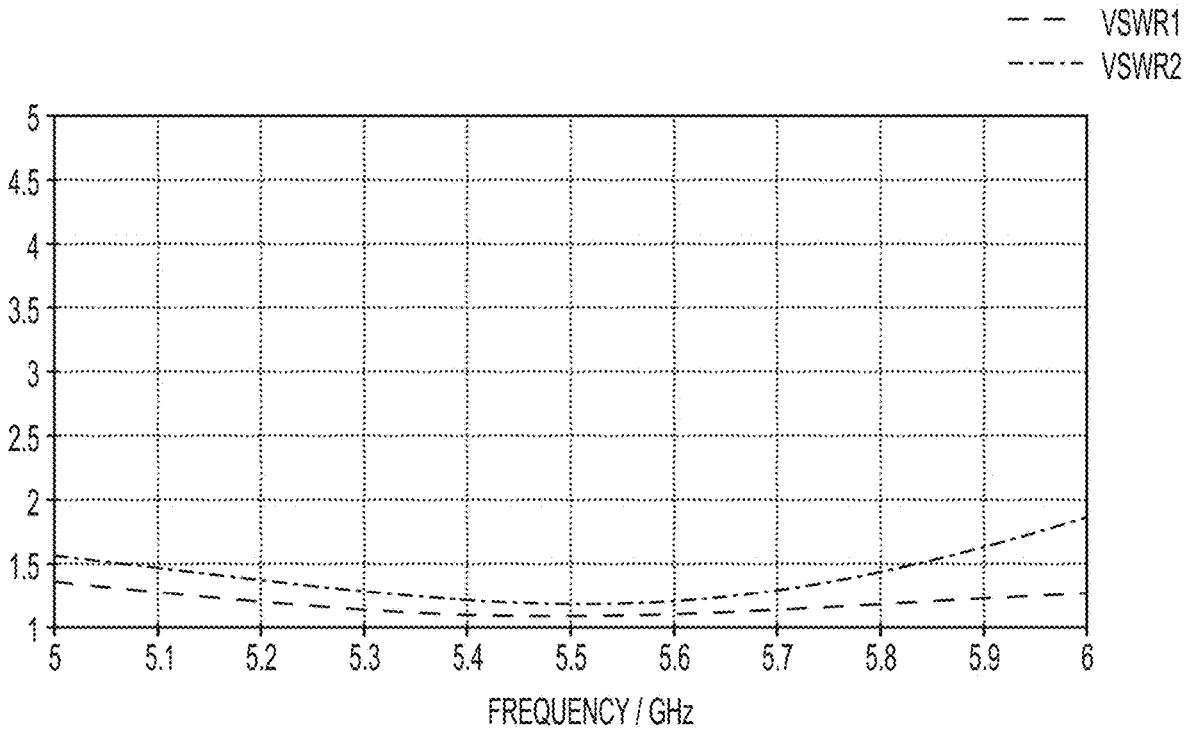
FIG. 20 is a graph of a voltage standing wave ratio of a dual-band antenna and a single-band antenna of a multiple antenna system in accordance with disclosed embodiments.
Figure 21:
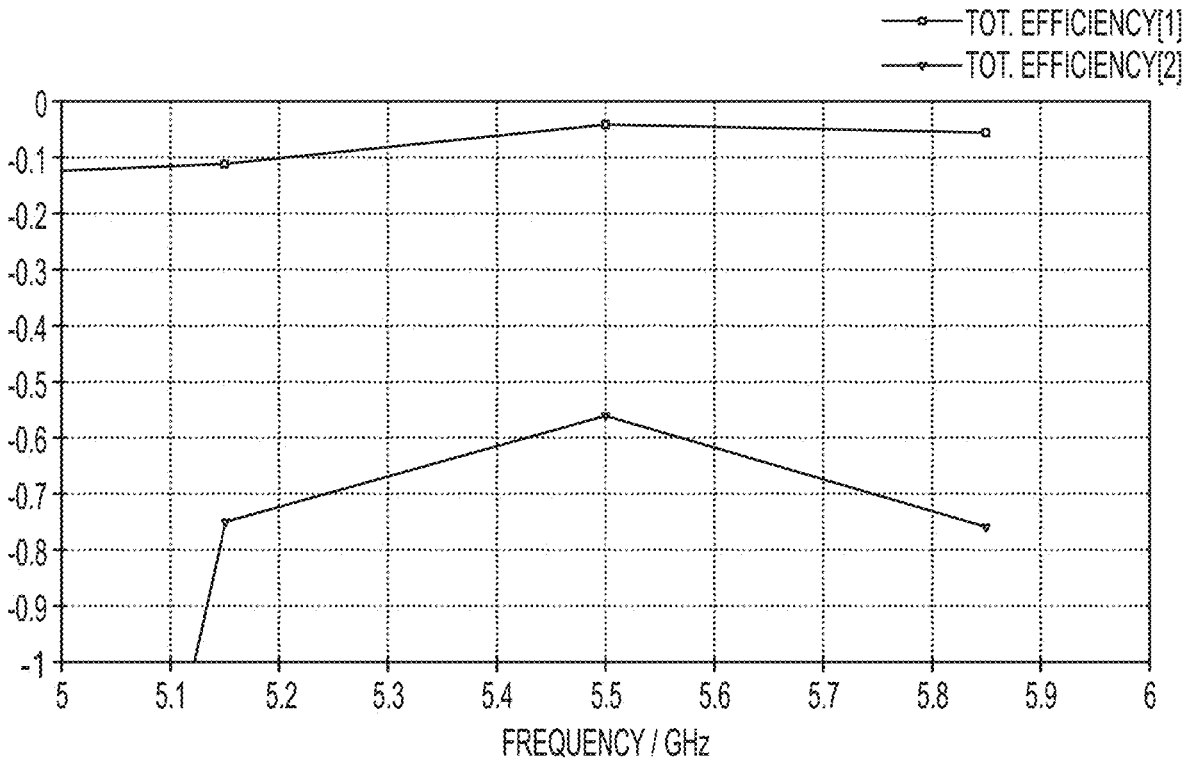
FIG. 21 is a graph of efficiency of a dual-band antenna and a single-band antenna of a multiple antenna system in accordance with disclosed embodiments.
Figure 22:
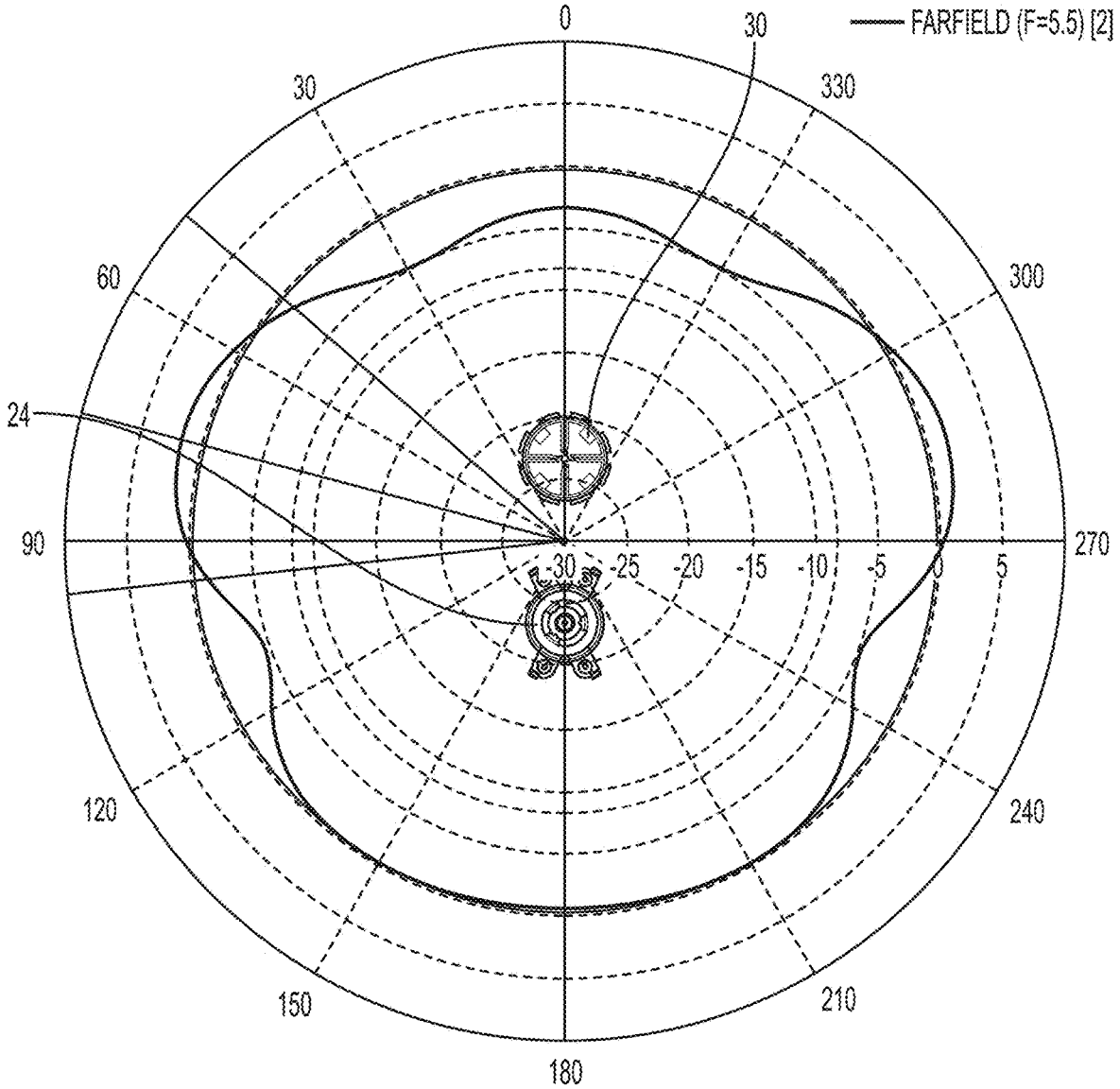
FIG. 22 is a graph of an azimuth plane radiation pattern of a dual-band antenna of a multiple antenna system in accordance with disclosed embodiments.
Figure 23:
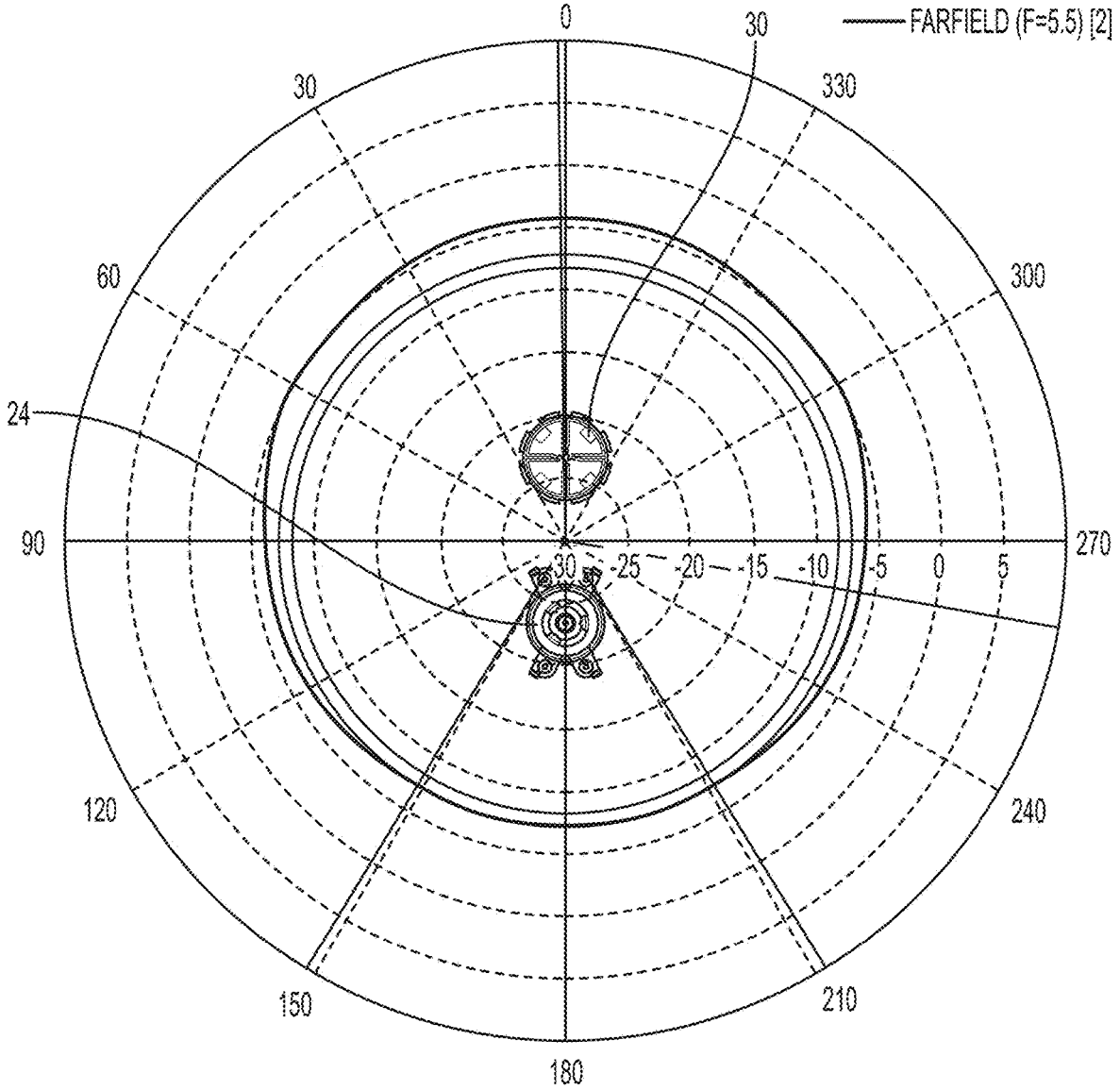
FIG. 23 is a graph of an azimuth plane radiation pattern of a single-band antenna of a multiple antenna system in accordance with disclosed embodiments.
Figure 24:
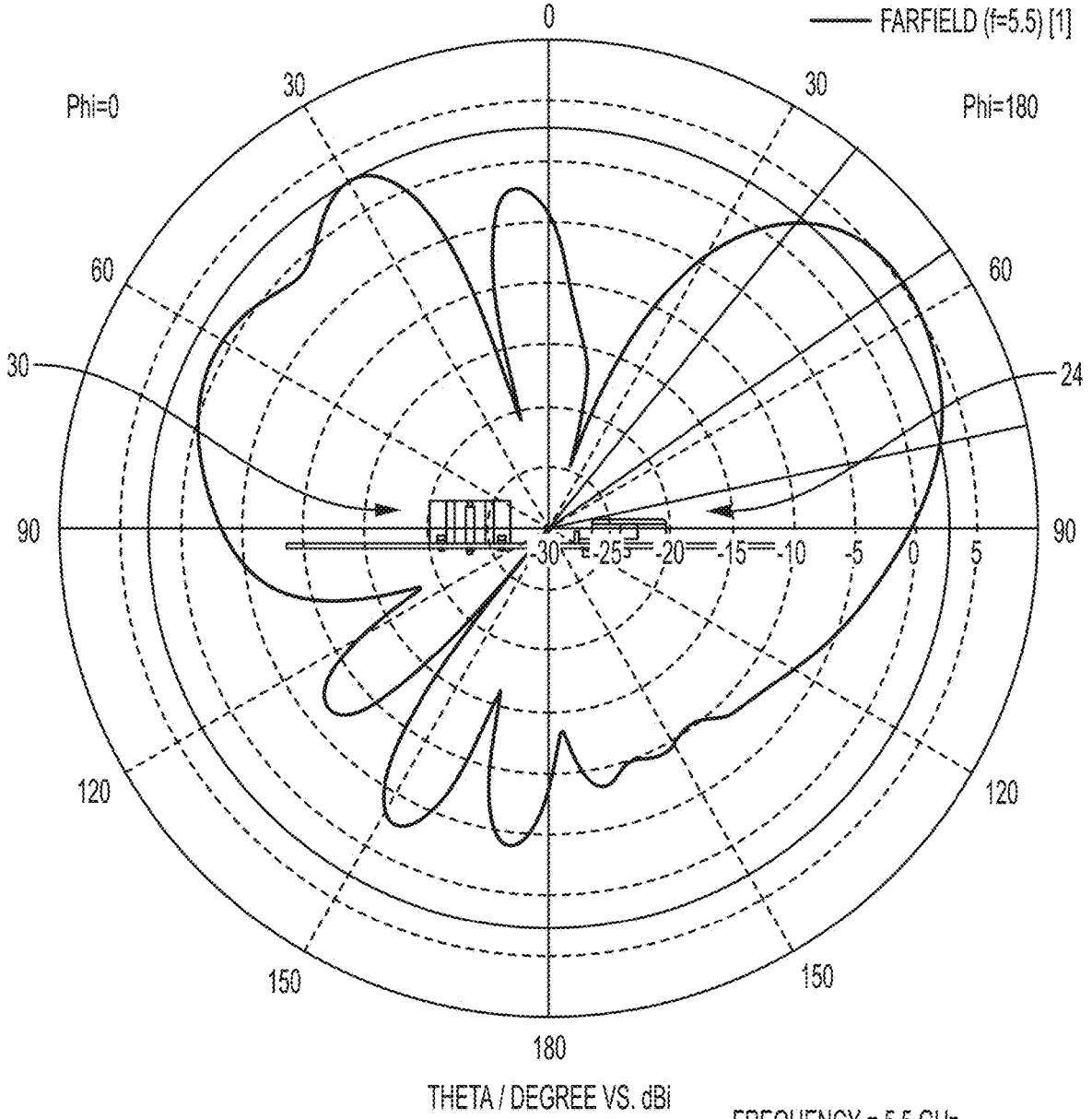
FIG. 24 is a graph of a Φ=0 elevation plane radiation pattern of a dual-band antenna of a multiple antenna system in accordance with disclosed embodiments.
Figure 25:
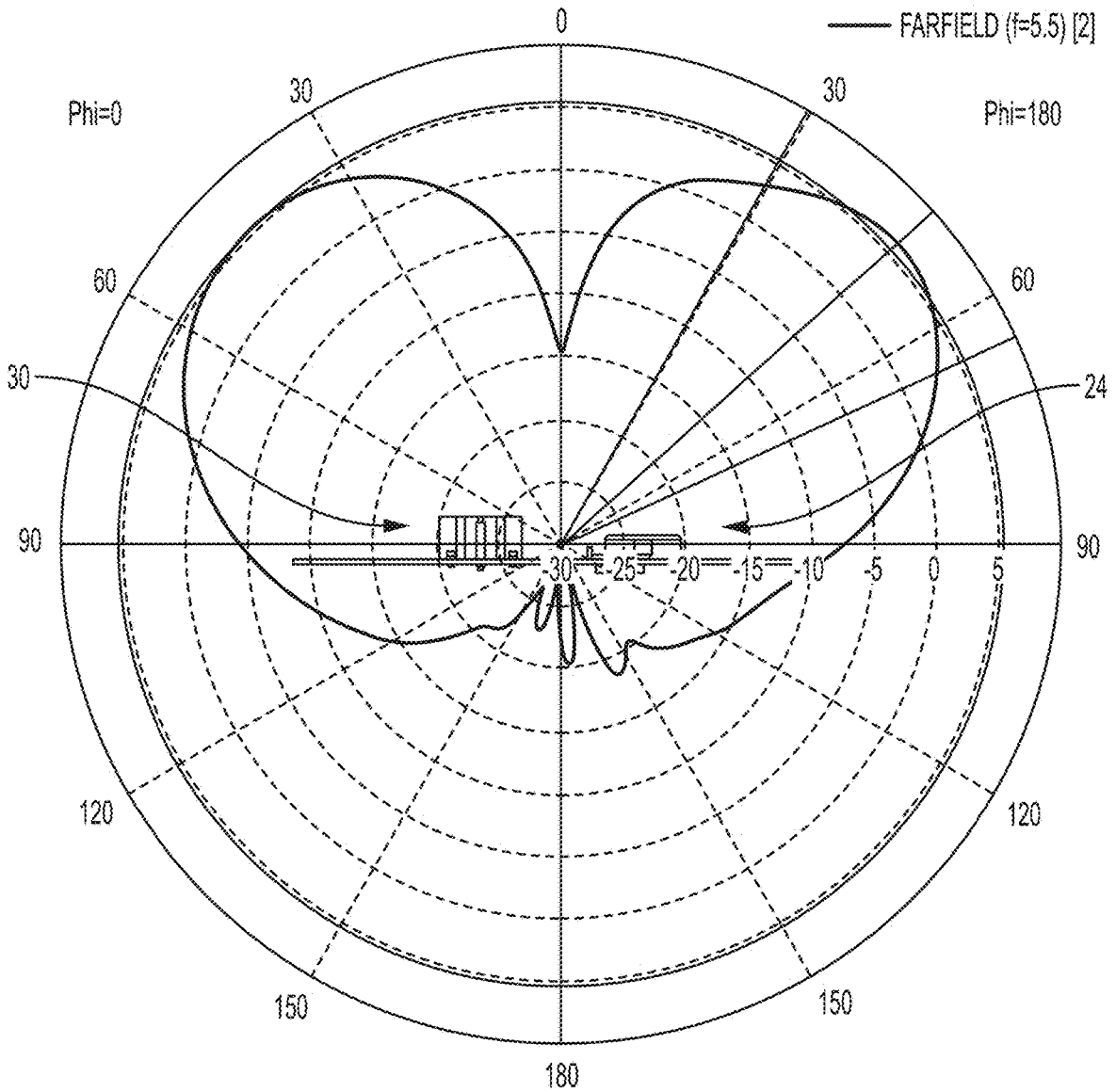
FIG. 25 is a graph of a Φ=0 elevation plane radiation pattern of a single-band antenna of a multiple antenna system in accordance with disclosed embodiments.
Figure 26:
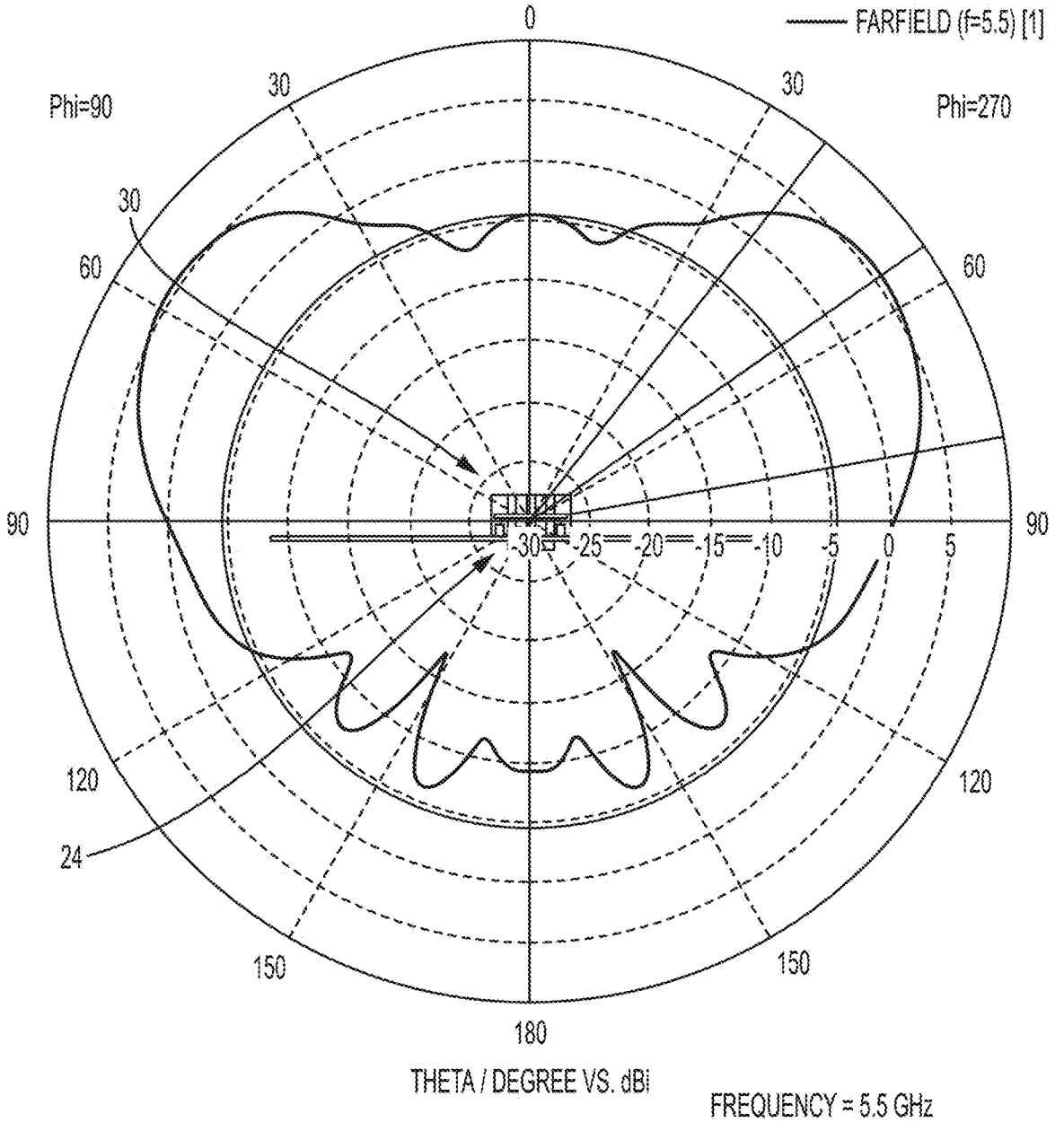
FIG. 26 is a graph of a Φ=90 elevation plane radiation pattern of a dual-band antenna of a multiple antenna system in accordance with disclosed embodiments.
Figure 27:
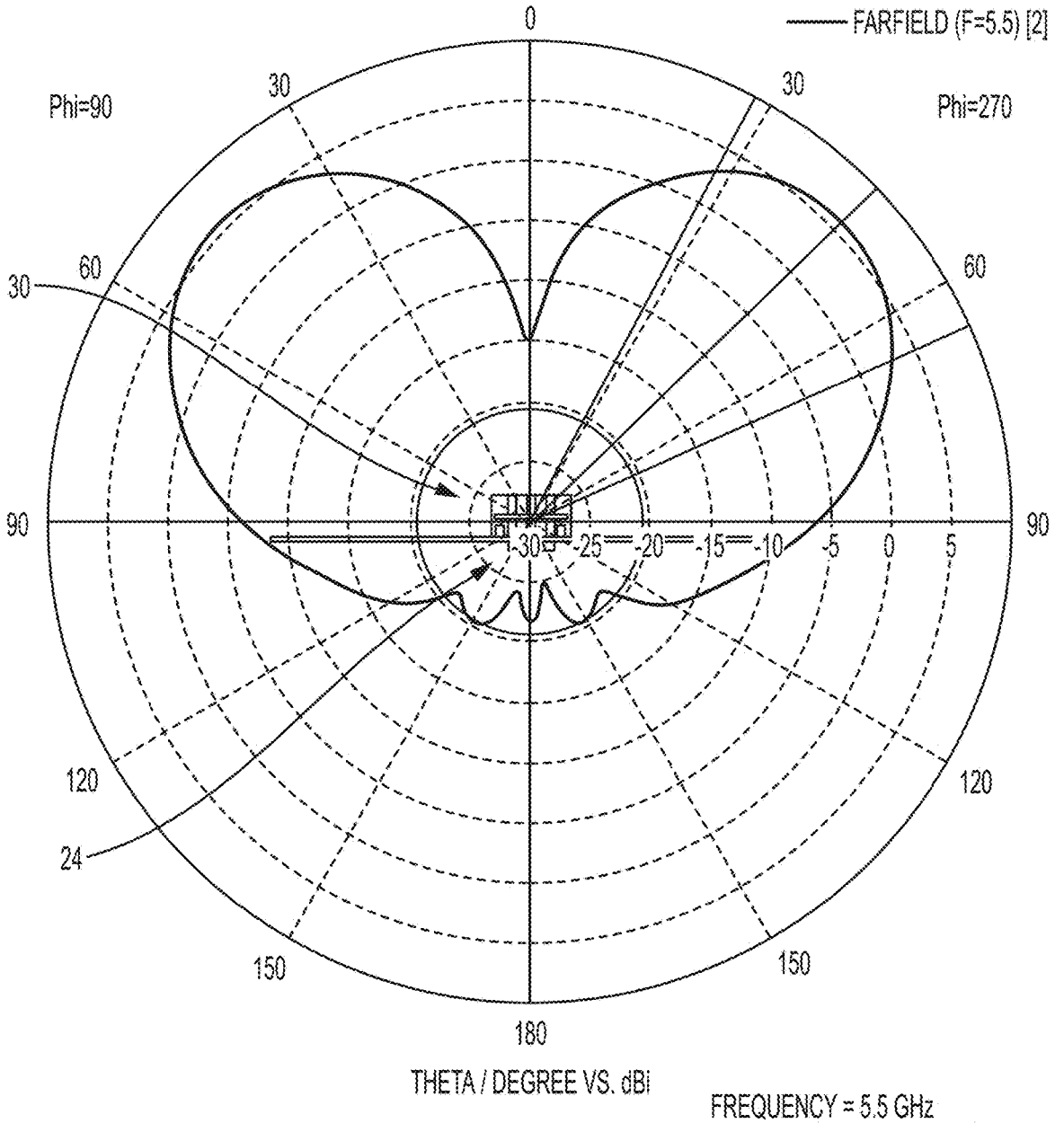
FIG. 27 is a graph of a Φ=90 elevation plane radiation pattern of a single-band antenna of a multiple antenna system in accordance with disclosed embodiments.

A VSWR and efficiency of the dual-band antenna 24 and the single-band antenna 22 coupled to the dual antenna support and isolation enhancer 32 are shown in FIG. 20 and FIG. 21, respectively, and radiation patterns for the dual-band antenna 24 and the single-band antenna 22 coupled to the dual antenna support and isolation enhancer 32 are shown in FIG. 22-FIG. 27. As seen in FIG. 20-FIG. 27, the dual antenna support and isolation enhancer 32 can enhance decoupling of the single-band antenna 22 and the dual-band antenna 24 while simultaneously maintaining the efficiency and performance of both the single-band antenna 22 and the dual-band antenna 24 relative to the performance without the dual antenna support and isolation enhancer 32 shown in FIG. 5-FIG. 12.

Although a few embodiments have been described in detail above, other modifications are possible. For example, other components may be added to or removed from the described systems, and other embodiments may be within the scope of the invention.

From the foregoing, it will be observed that numerous variations and modifications may be effected without departing from the spirit and scope of the invention. It is to be understood that no limitation with respect to the specific system or method described herein is intended or should be inferred. It is, of course, intended to cover all such modifications as fall within the spirit and scope of the invention.

What is claimed is:

1. A method comprising:

fastening a dual antenna support and isolation enhancer to a ground plane;

coupling the dual antenna support and isolation enhancer to a first antenna element fed by a coaxial cable to support the first antenna element in an elevated position relative to the ground plane; and the dual antenna support and isolation enhancer isolating a shield of the coaxial cable and portions of the first antenna element from external radiation that would otherwise induce current on the shield of the coaxial cable and incur coupling to the portions of the first antenna element.

2. The method of claim 1 further comprising the dual antenna support and isolation enhancer supporting the first antenna element parallel to the ground plane.

3. The method of claim 1 further comprising:

at least one of a plurality of loading pins and a plurality of support tabs of the dual antenna support and isolation enhancer isolating the shield of the coaxial cable and the portions of the first antenna element from the external radiation; and coupling the plurality of support tabs to the first antenna element to support the first antenna element in the elevated position relative to the ground plane.

4. The method of claim 3 wherein each of the plurality of support tabs has a length that is at or near a quarter wavelength of a design frequency of the first antenna element.

5. The method of claim 3 further comprising a respective protrusion on each of the plurality of support tabs traversing and soldered to a printed circuit board of the first antenna element.

6. The method of claim 3 further comprising coupling a second antenna element to the ground plane, wherein the second antenna element emits the external radiation.

7. The method of claim 6 further comprising tuning a length of the at least one of the plurality of loading pins to a quarter wavelength of a design frequency of the second antenna element.

8. The method of claim 6 further comprising positioning the at least one of the plurality of loading pins between the second antenna element and the coaxial cable.

9. The method of claim 6 further comprising tuning a width of a gap between the at least one of the plurality of loading pins and the portions of the first antenna element relative to a design frequency of the second antenna element.

10. The method of claim 3 wherein the portions of the first antenna element include a gap of a coplanar strip transmission line, and wherein an induced electric field at a tip of the at least one of the plurality of loading pins open-circuits the coplanar strip transmission line.

* * * * *